United States Patent [19]

Ishida et al.

[11] 4,043,097

[45] Aug. 23, 1977

[54] APPARATUS FOR PACKAGING A PLURALITY OF YARN PACKAGES IN A CARDBOARD BOX OR A LIKE CONTAINER

[75] Inventors: Kinyu Ishida, Takatsuki; Kenji Gose, Ashiya; Shigeo Matsunami, Matsuyama; Miyoyuki Sigeoka, Matsuyama; Teruichi Matsumura, Matsuyama, all of Japan

[73] Assignees: Teijin Limited; Teijin Seiki Co., Ltd., both of Osaka, Japan

[21] Appl. No.: 729,293

[22] Filed: Oct. 4, 1976

[30] Foreign Application Priority Data

Oct. 3, 1975 Japan ..... 50-118934

[51] Int. Cl.[2] ..... B65B 5/08; B65B 35/36; B65B 57/00

[52] U.S. Cl. ..... 53/52; 53/157; 53/162; 53/164; 53/245; 53/247; 214/6 M

[58] Field of Search ..... 53/52, 67, 157, 159, 53/162, 164, 165, 198 R, 244, 245, 247, 266; 214/6 M, 6 P

[56] References Cited

U.S. PATENT DOCUMENTS

| | | | |
|---|---|---|---|
| 2,524,846 | 11/1950 | Socke et al. | 53/165 X |
| 3,431,698 | 3/1969 | Bathellier | 53/157 X |
| 3,946,884 | 3/1976 | Kato et al. | 53/159 X |

*Primary Examiner*—Robert Louis Spruill
*Attorney, Agent, or Firm*—Burgess, Ryan and Wayne

[57] ABSTRACT

An apparatus for packaging yarn packages in plural layers in a cardboard box or a like container is disclosed. A plurality of yarn packages carried to a packaging station by a transporting carrier are grouped in several groups and, then, a group of yarn packages is received by a supporting means with sufficient intervening space between two adjacent yarn packages for easy mechanical handling. Then, the above-mentioned space between two adjacent yarn packages is contracted automatically while the group of yarn packages is carried to a station for transferring them into a cardboard box or a like container, so as to fix the disposition of the yarn packages in the arrangement of a square lattice on a partition plate disposed in the container. When a plurality of yarn packages have been disposed in one layer in the container an intermediate partition plate is utilized for covering and fixing the upper end of the bobbin of each yarn package in that layer and fixing the lower end of each bobbin in the succeeding layer. When the package contains a plurality of such layers, an upper partition plate is utilized to cover and fix the upper end of the bobbin of each yarn package in the uppermost layer. In the apparatus of the present invention, auxiliary mechanisms such as a partition plate feeding device, a pallet lifting device, etc., are preferably utilized.

13 Claims, 32 Drawing Figures

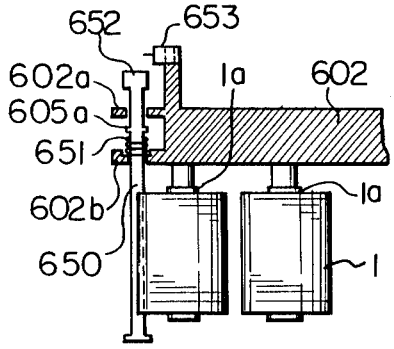
Fig. 17A
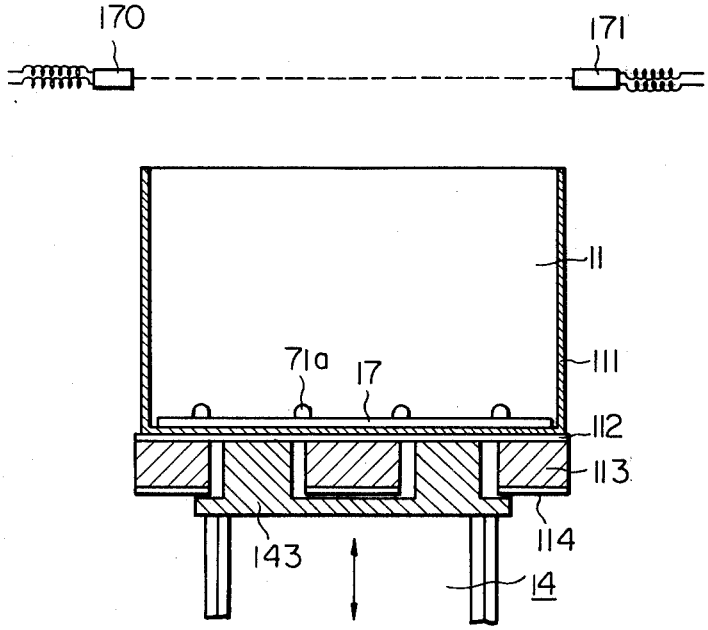

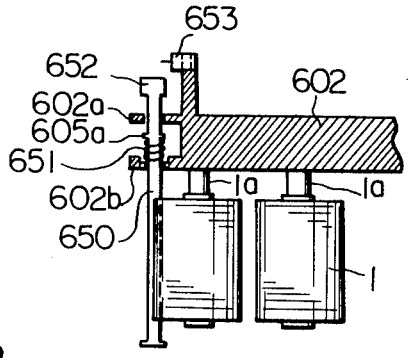
Fig. 17B
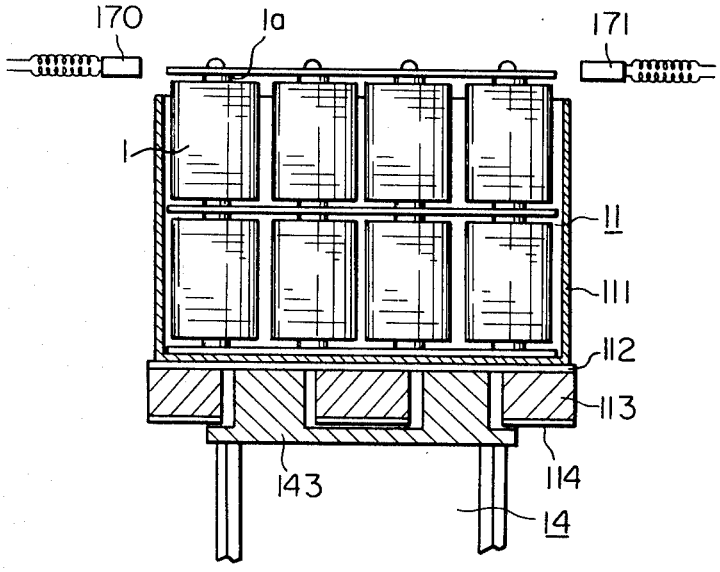

APPARATUS FOR PACKAGING A PLURALITY OF YARN PACKAGES IN A CARDBOARD BOX OR A LIKE CONTAINER

SUMMARY OF THE INVENTION

This invention relates to an apparatus for packaging yarn packages and, more particularly, relates to an apparatus for packaging a plurality of yarn packages in a state of arrangement of plural layers in a cardboard box or a like container.

In general, cheeses or similar yarn packages formed by yarn processing apparatuses, such as spinning machines, drawing-twisting machines and draw false twisters are packaged as a group of four to eight cheeses in a cardboard box or wooden box for transporation to a subsequent process, remote factories or consumers. Because the surface portions of these yarn packages are easily damaged by shocks and the like, and because these yarn packages have a relatively large diameter and heavy weight, they have heretofore been packaged in a cardboard box or a wooden box in a state of arrangement of only one layer. According to this conventional packaging method, however, various disadvantages are brought about. For example, the packaging cost per yarn package is high, and when the yarn packages are loaded on transporting vehicles, such as the trucks and freight cars, in order to facilitate the loading operation by a fork lift or the like, it is necessary to perform a palletizing step for stacking a plurality of the carboard boxes or wooden boxes on a pallet.

The object of the present invention is to provide a unique apparatus for packaging a plurality of yarn packages which effectively eliminates manual operations and can efficiently package a plurality of yarn packages in a plural layer arrangement in a large cardboard or wooden box or similar container.

To attain the above-mentioned object, in the apparatus according to the present invention, the packaging operation is carried out automatically by an apparatus provided with, at least: a first mechanism for displacing a group of yarn packages in upright condition from a terminal of a process for carrying these yarn packages from a yarn package forming process to an unloading position thereof, a second mechanism for receiving the above-mentioned yarn packages from the first mechanism and for transferring these yarn packages into a cardboard box or similar container, including a wooden box; a third mechanism mounted on the second mechanism for compacting the arrangement space of the above-mentioned group of yarn packages to a proper space-fit arrangement for depositing these yarn packages into the cardboard box or similar container; a fourth mechanism for displacing the second mechanism from a first position where the second mechanism receives the group of yarn packages from the first mechanism to a second position where these yarn packages are transferred from the second mechanism to the cardboard box or similar container; a fifth mechanism for displacing a cardboard box or similar container to a third position below the above-mentioned second position of the fourth mechanism; a sixth mechanism for displacing a cardboard box or similar container from the third position to a fourth position where the second mechanism deposits the above-mentioned group of yarn packages into the cardboard box or similar container displaced thereto. Several auxiliary mechanisms, such as a mechanism for receiving a group of yarn packages from a transporation carrier where these yarn packages are held in a two package alignment arrangement, a mechanism for holding these yarn packages in upright condition and a mechanism for shortening the intervening space between the two package alignment arrangement of yarn packages, are utilized for the apparatus according to the present invention. These three auxiliary mechanisms are mounted on the first mechanism.

When a group of yarn packages are held in a cardboard box or similar container, it is essential to hold them in a stable condition without contact with each other. To satisfy this requirement, a supporting plate provided with a plurality of holding caps is utilized. These holding caps are rigidly mounted on the supporting plate in such a way that the arrangement thereof coincides with the desired arrangement of the yarn packages in the cardboard box or similar container. A pair of the above-mentioned supporting plates are preferably disposed in the carboard box in such a condition that they sandwich a plurality of yarn packages, each pair of holding caps of the above-mentioned two supporting plates stably holding a yarn package. Therefore, in the present invention, a further auxiliary mechanism for supplying the above-mentioned supporting plates into cardboard box or similar container positioned at the above-mentioned fourth position is preferably utilized.

As mentioned above, the packaging operation of the yarn packages can be carried out mechanically and the yarn packages can be stably held in a cardboard box or similar container without contacting each other, and therefore, the disadvantages of the conventional packaging method are remarkably eliminated.

BRIEF EXPLANATION OF THE DRAWING

FIGS. 17A and 17B show the devices for controlling the loading motion of the cheeses into a cardboard box by means of the pallet lifting devices shown in FIGS. 16A and 16B;

DETAILED EXPLANATION OF THE INVENTION

Figure 1:
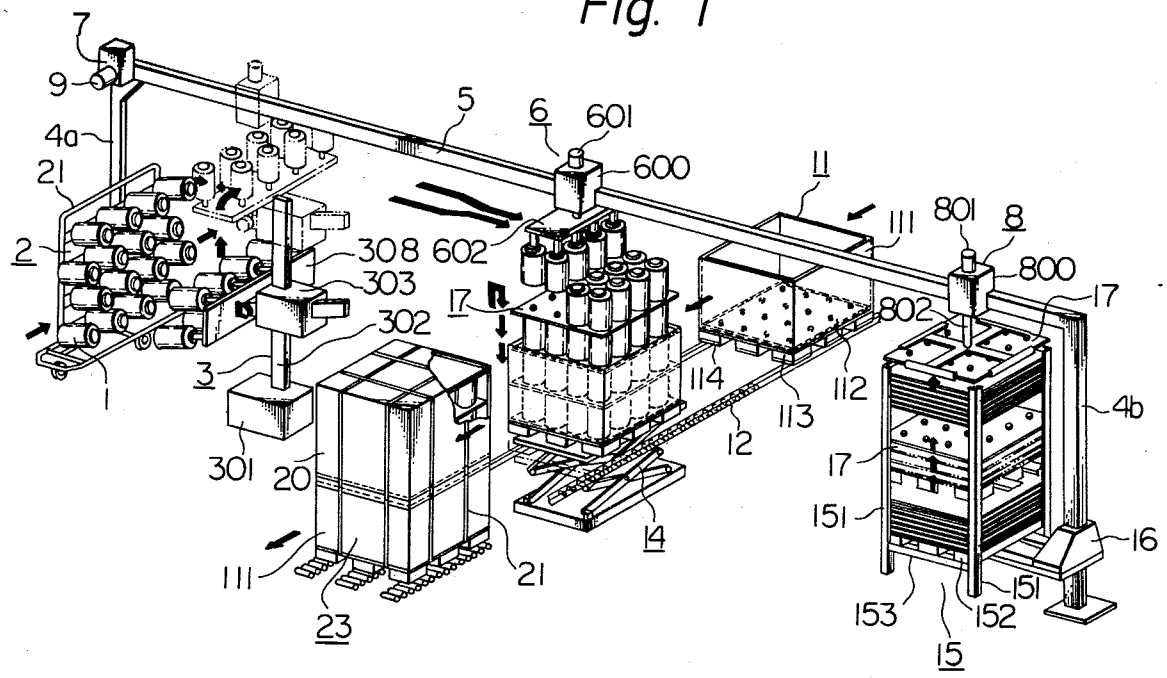
FIG. 1 is a perspective view of an embodiment of the packaging apparatus according to the present invention.

The general construction, function of the preferable packaging apparatus according to the present invention is hereinafter explained with reference to FIGS. 1 and 2. This packaging apparatus is particularly designed for making carton packages by directly receiving a group of yarn packages transported by a transporting truck 2 which has been moved from a yarn package forming process to a position for transferring these yarn packages to this packaging apparatus. (A yarn package is hereinafter referred to as a cheese). In this embodiment, the transporting truck 2 carries 16 cheeses 1 in such an arrangement that four cheeses are held in a horizontal alignment with each other and there are four parallel alignments of cheeses. Each cheese 1 is supported by one of 16 pegs which are rigidly mounted on the transporting truck 2 in a condition which satisfies the above-mentioned arrangement of 16 cheeses. To reduce the space for supporting these cheeses 1 and also to prevent possible contact of two adjacent cheeses, the relative positions of the pegs with respect to the four horizontal alignments of the cheeses is designed in zig-zag condition. Each peg is rigidly mounted on a vertical frame 21 of the transporting truck 2 in such a condition that the free end of each peg is positioned above the fixed end thereof so as to stably hold a cheese 1 during the transportation.

Figure 3A:
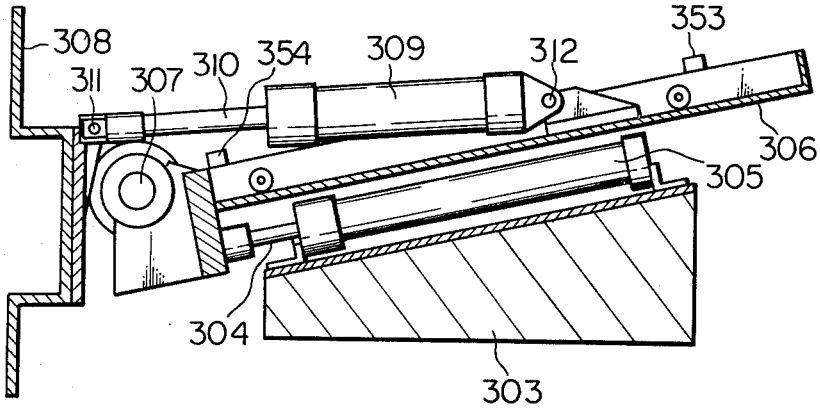
FIG. 3A is a side view of a mechanism for turning a supporting member holding plate of a lift shown in FIGS. 1 and 2.
Figure 3B:
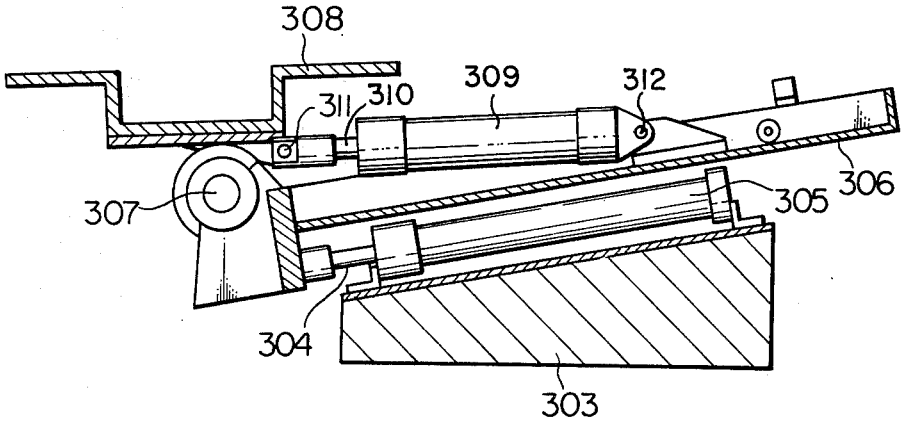
FIG. 3B is a similar side view of the mechanism shown in FIG. 3A, in different actuated condition.
Figure 4:
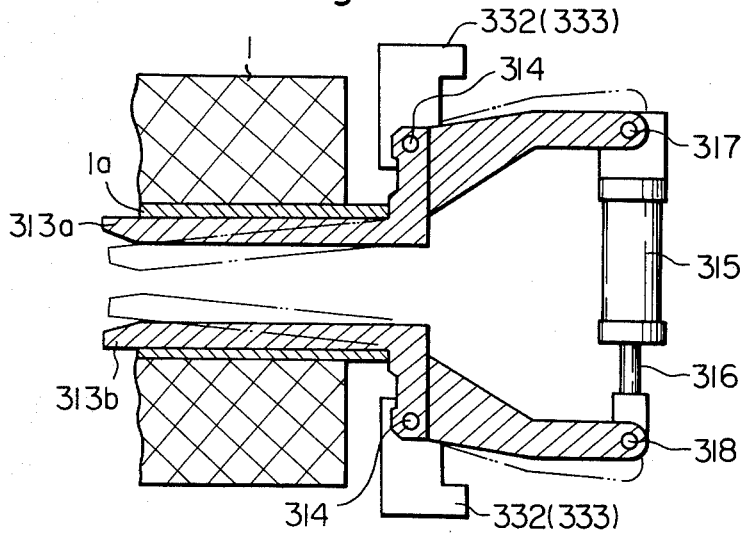
FIG. 4 is a side view of an embodiment of a bobbin supporting member utilized for the lift shown in FIG. 1.

A first mechanism 3 for displacing a group of cheeses 1 in upright condition is disposed at a standby position of the transporting truck 2. This mechanism is hereinafter referred to as a lift. In this lift 3, a chain driving device (not shown) is housed in a base stand 301. A chain (not shown) is driven and circulated in the interior of a guide shaft 302, extending upwardly and vertically from the stand 301, by means of the above-mentioned driving device, whereby a slide block 303 engaged with the chain is moved up and down. At first, the slide block 303 rises to a point confronting the pegs of the upper two horizontal alignments in the transporting truck 2 positioned at the standby position and is stopped at this point. As illustrated in detail in FIGS. 3A and 3B, a pneumatic cylinder 305 is rigidly mounted on the slide block 303 in an inclined condition at the same angle as the inclination angle of the pegs on the transporting truck 2. When this pneumatic cylinder 305 is operated, an arm 306 secured to the top end of a rod 304 of a pneumatic cylinder 305 is moved outwardly. A supporting plate 308 is turnably mounted on an end portion of the arm 306 so that it is capable turning about a rotary shaft 307. The supporting plate 308 and arm 306 are hinged to the ends of a turning pneumatic cylinder 309 and a piston rod 310 thereof through pins 311 and 312, respectively. Therefore the motion of the cylinder 309 and rod 310 is not disturbed. As shown in FIG. 4, pairs of bobbin supporting members **313*a*, 313*b*, the number of the pairs of bobbin supporting members 313*a* and 313*b* corresponding to number of the pegs in the transporting truck 2, are turnably mounted on auxiliary frames 332 (333) mounted on the supporting plate 308 (see FIGS. 1, 3A and 6A) by corresponding pins 314 at the positions corresponding the arrangement of the pegs of the transporting truck 2. The supporting members 313*a*, 313*b* of each pair are hinged to the end of a supporting pneumatic cylinder 315 or a supporting rod 316 through a pin 317 or 318 so that the cylinder 315 or the rod 316 are capable of moving freely. The bobbin supporting members 313*a*, 313*b* are positioned normally in the closed condition, as indicated by two dot chain lines in FIG. 4, while maintaining the rod 316 of the supporting air cylinder 315 in the elongated state. When the bobbin supporting members 313*a*, 313*b* are inserted into the bore of a bobbin 1*a* of a cheese 1 supported on the pegs on the transporting truck 2, by actuation of the air cylinder 305 so as to project the piston rod 304 in the outward direction, and the supporting air cylinder 315 is then operated to contract the rod 316, the pair of the bobbin supporting members 313*a*, 313*b* are moved to the opened condition as indicated by the solid line in FIG. 4. In this condition, the cheese 1 is supported by the pair of the bobbing supporting members 313*a*, 313*b*.**

In this condition where the cheese 1 is supported by the pair of bobbin supporting members **313*a*, 313*b*, the air cylinder 305 is operated in the reverse direction and, accordingly, eight cheeses 1 supported by the pegs of the upper two horizontal alignments in the transportation truck 2 are simultaneously taken off of the pegs of the transporting truck 2. In this condition, the air cylinder 309 is actuated to retract the piston rod 310 so that the supporting plate 308k is turned in the clockwise direction in FIG. 3A and, consequently, the suppporting plate 308 is turned to the position shown in FIG. 3B.**

The chain driving device for displacing the slide block 303 is hereinafter explained in detail with reference to FIGS. 5A, 5B and 5C.

Figure 5A:
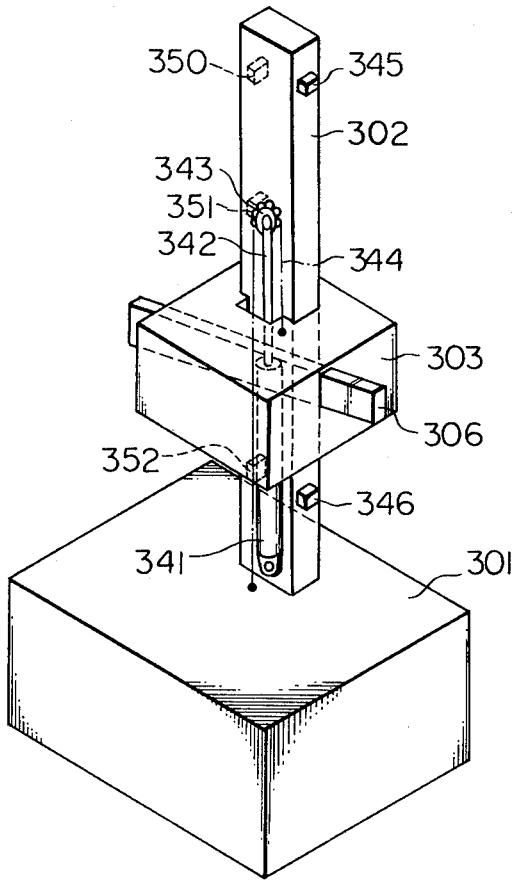
FIG. 5A is a perspective view of the lift utilized for the apparatus shown in FIG. 1.
Figure 5B:
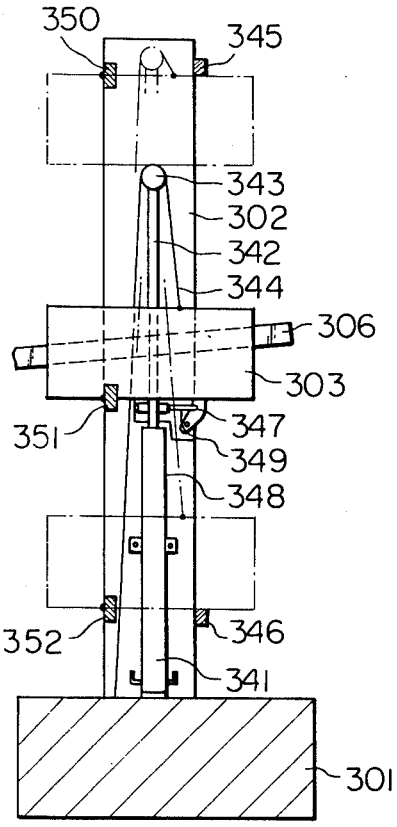
FIG. 5B and 5C are front and plan views of the lift shown in FIG. 5A.
Figure 5C:
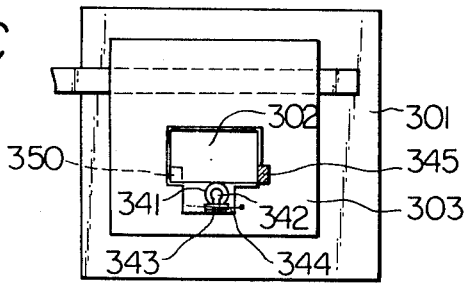

Referring to FIGS. 5A, 5B and 5C, the lift 3 comprises a base stand 301, a vertically extending guide shaft 302 fixed on the base stand 301, and a slide block 303 mounted in a manner so that it is capable of moving up and down along the guide shaft 302. On one side of a lower portion of the guide shaft 302, there is rigidly mounted a pneumatic cylinder 341 having a vertically workable piston rod 342. On a side of the top end of the piston rod 342 a sprocket pulley 343 carrying a chain 344 is rotatably mounted. The chain 344 is attached to the slide block 303 at one end and to the base stand 301 at the other end. Accordingly, when the sprocket wheel 343 is caused to move upwardly or downwardly by the projecting motion or retracting motion of the piston rod 342, the slide block 303 connected to one end of the chain 344 is also caused to move correspondingly upwards or downwards. It will be obvious that the travelling distance of the slide block 303 is twice that of the sprocket wheel 343 (or piston rod 342).

The guide shaft 302 is further provided with limit switches 350, 351 and 352 for detecting the uppermost level of the slide block 303, the intermediate level of the slide block 303 for handling the upper rows of cheeses 1 in the transportation truck 2 of the block 303 and the lowermost level of the slide block 303 for handling the lower two rows of cheeses 1 in the transportation truck 2, respectively. The guide shaft 302 is also provided with fixed stoppers 345 and 346 for setting the uppermost and lowermost levels of the slide block 303 and a projectable stopper 347 for setting the intermediate level of the slide block 303. One end of the projectable stopper 357 is pivotably attached to the guide shaft 302 while the other end is pivotably attached to a piston rod 349 of a pneumatic cylinder 348, the opposite end of which pneumatic cylinder is pivotably mounted on the guide shaft 302.

In order to raise the slide block 303 from the lowermost level to the uppermost level, the stopper 347 is caused to retract into the guide shaft 302 by retracting the piston rod 349 of the pneumatic cylinder 348 and then the piston rod 342 of the pneumatic cylinder 341 is caused to project until the limit switch 350 operates. When the slide block 303 is to be caused to descend from the uppermost level to the lowermost level, the piston rod 342 of the pneumatic cylinder 341 is caused to retract into the cylinder 341 until the limit switch 352 operates while keeping the stopper 347 retracted in the guide shaft 302 by the retracting motion of the piston rod 349 of the pneumatic cylinder 348. When the slide block 303 is to be caused to descend from the uppermost level to the intermediate level, the stopper 357 is caused to project from the guide shaft 302 by the projecting motion of the piston rod 349 of the cylinder 348 and then the piston rod 352 of the pneumatic cylinder 341 is caused to retract thereinto until the limit switch 351 operates.

Figure 6B:
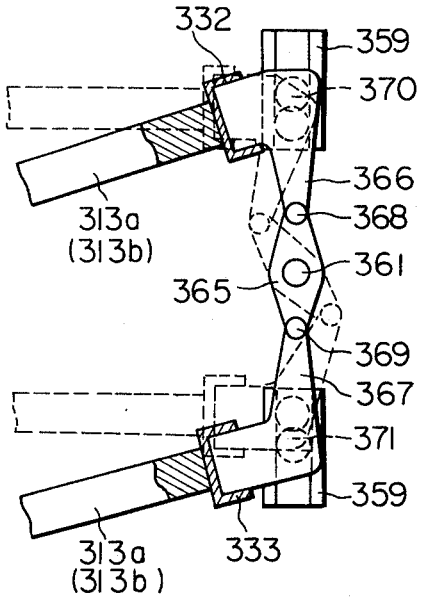
FIG. 6B is a perspective side view of a part of the space contracting mechanism shown in FIG. 6A.
Figure 6A:
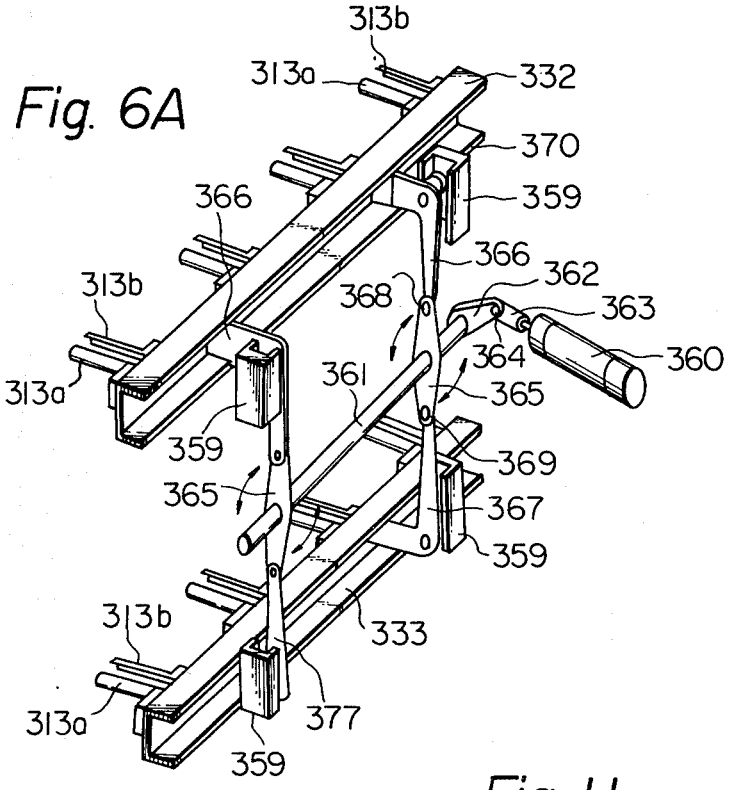
FIG. 6A is a schematic perspective view of the first space contracting mechanism mounted on the lift shown in FIG. 1.

An auxiliary mechanism for contracting the space between every two adjacent horizontal alignments of the cheeses 1 to a narrow space substantially equal to the space in the packaged condition of the cheeses 1 is hereinafter described in detail. This mechanism is hereinafter referred to as a first space contracting mechanism. Referring to FIGS. 6A and 6B, the construction and function of this mechanism is hereinafter explained in detail. Four slide rails 359 shown in FIG. 6A are fixed to the supporting plate 308 (shown in FIG. 1), and a contracting air cylinder 360 and a rotary shaft 361 are turnably mounted on the supporting plate 308. A swinging arm 362 fixed to one end of the turning shaft 361 is turnably hinged to a rod 363 of the contracting air cylinder 360 through a pin 364. A pair of turning arms 365 is fixed to the turning shaft 361, and a pair of L-shaped contracting arms 366 and 367 is hinged to the ends of the turning arm through pins 368 and 369, respectively. Slide rollers 370 and 371 are rotatably mounted at the bends of the L-shaped contracting arms 366 and 367, respectively, and frames 332 and 333 are disposed on the other ends from the turning arm of the contracting arms 366 and 367, respectively. Four pairs of the above-mentioned bobbing supporting members **313*a*, 313*b*, the details of which are shown in FIG. 4, are mounted on each of the frames 332 and 333 so that the space between the two adjacent alignments of the pairs of bobbin supporting members 313*a*, 313*b* corresponds to the distance between the two adjacent alignments of the pegs in the transporting truck 2.**

When the contracting air cylinder 360 is actuated in this condition, the turning shaft 361 is turned by a predetermined angle by way of the swinging arm 362 and the rod 363, whereby the turning arm 365 is turned by a predetermined angle to move the contracting arm 366 downwardly and the contracting arm 367 upwardly. At this time, the moving courses of the slide rollers 370 and 371, mounted at the bends of the L-shaped contracting arms 366 and 367, are controlled by the slide rails 359 so that the condition of the contracting arms 366 and 367 indicated by solid lines in FIG. 6B is changed to the condition indicated by broken lines in FIG. 6B. As a result, distance between the frames 332 and 333 rigidly mounted on the ends of the contracting arms 366 and 367 is shortened and, simultaneously, the inclination angle of the frames 332 and 333 (namely, the same angle as the inclination angle of the pegs on the transporting truck 2) is changed to the horizontal angle. Accordingly, by the above-mentioned operation, the axial direction of the cheese 1 supported by the bobbin supporting members **313*a*, 313*b* is changed to the horizontal direction and the space between every two adjacent cheeses 1 supported by the bobbin supporting members 313*a*, 313*b* of two different frames 332, 333** is contracted to a narrow space substantially identical to the space in the packaged condition.

When the operation of the first contracting mechanism is completed, the driving device is actuated again, and the slide block 303 is lifted up and shifted to the uppermost part of the slide guide shaft 302. In this condition, the air cylinder 309 is operated so as to retract the rod 310, thereinto, whereby the supporting plate 308 is turned by 90° about the shaft 307 and, consequently, the cheeses 1 are supported in the upright condition as indicated by broken lines in FIG. 1.

Figure 8:
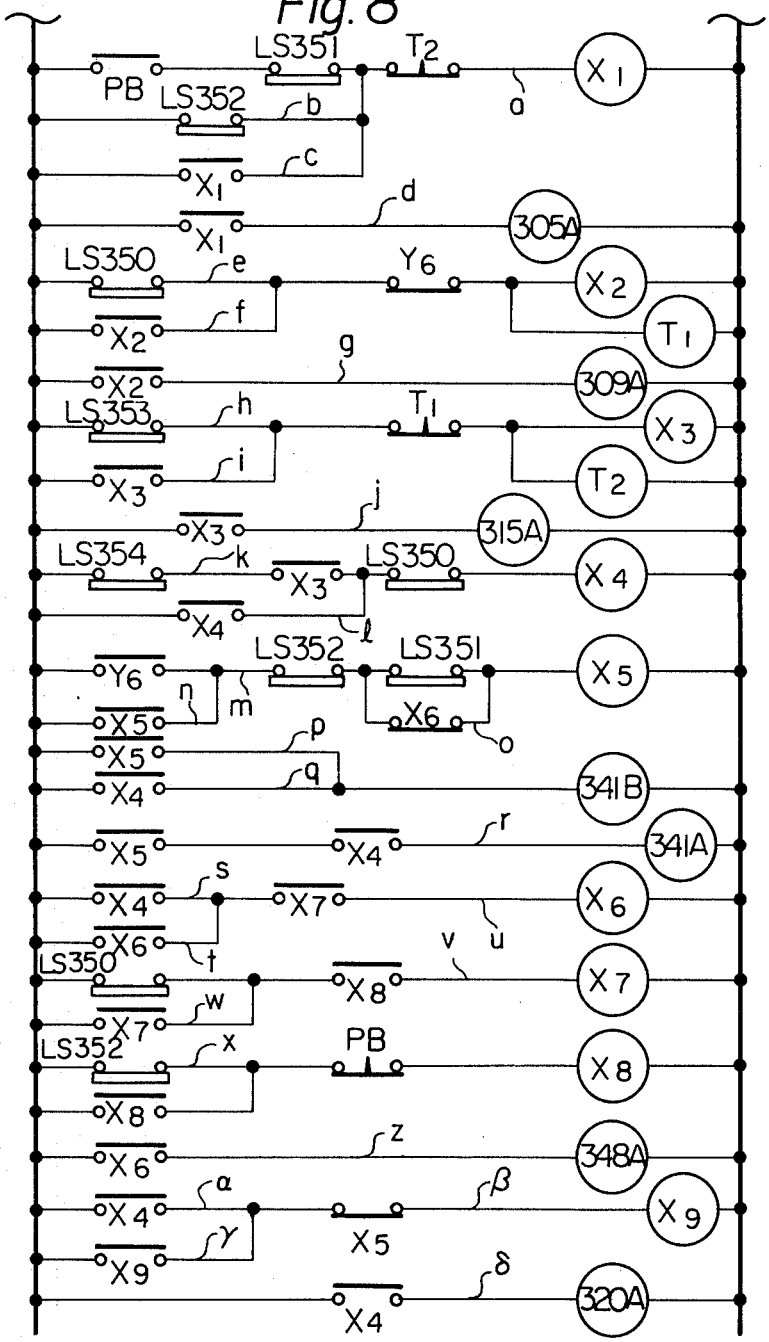
FIG. 8 is a diagram of an electric circuit utilized for actuating the lift shown in FIG. 1.

Next, the operation system of the lift 3 together with the driving mechanism and the auxiliary mechanism is hereinafter explained with reference to the pneumatic circuit for actuating the respective pneumatic cylinders 305, 309, 315, 358 and 360 shown in FIGS. 3A, 4, 5A, 5B, 6, 7 and 8. In FIG. 8, the limit switches are represented by LS.

When the transportation truck 2 has been brought into the unloading position, a push-button switch PB is closed. At this moment the slide block 303 is in the intermediate level and the limit switch 351 is closing. Accordingly, when the push-button switch PB closes a relay $X_1$ operates and is kept latched on. By the closing of contact of the relay $X_1$, an electro-magnetic valve 305A is actuated and a piston rod 304 of the pneumatic cylinder 305 is caused to project therefrom. As a result, the arm 306 moves obliquely downwardly a predetermined distance and the limit switch 353 operates. Whereupon a relay $X_3$ is actuated and kept latched on, and a timer $T_2$ resets. By the closing of the contact of the relay $X_3$, an electromagnetic valve 315A is actuated whereby the piston rod 316 of the pneumatic cylinder 315 is caused to contract and each pair of the bobbin holders 313*a*, 313*b* hold respective yarn packages 1. The timer $T_2$ sets the time $t_2$ required for the pairs of bobbin holders 313*a*, 313*b* to complete the bobbin holding operation. At the end of the timing period, the timer $T_2$ trips, contact of the timer $T_2$ opens and the relay $X_1$ is released from being kept latched on, whereby the electro-magnetic valve 305A is denergized and the piston rod 304 of the pneumatic cylinder 305 is caused to retract into the cylinder to return the arm 306 to the original position until a limit switch 354 closes. Since the relay $X_3$ has been operating, the closing of the limit switch 354 actuates a relay $X_4$ and keeps it latched on, and the closing of contact of the relay $X_4$ actuates relays $X_6$ and $X_9$ and keeps them latched on. Further, electromagnetic valves 341B, 348A and 320A are actuated by the closing of contact of the relay $X_4$, that of contact A of the relay $X_6$ and that of contact A of the relay $X_9$, respectively. As a result, the piston rod 342 of the cylinder 341 is projected to cause the slide block 303 to move upwrdly and at the same time the piston rod 323 of the pneumatic cylinder 320 is projected therefrom to carry out the above-mentioned space-contracting operation, namely the operation to shorten the distance between two alignments of cheeses 1 held on the bobbin holders and to change the holding direction to a horizontal direction. At this moment the stopper 347 is caused to retract into the guide shaft 302 by the retraction of the piston rod 349 of the pneumatic cylinder 348.

When the limit switch 350 closes by the ascending of the slide block 303, the relay $X_2$ is actuated and kept latched on, and a timer $T_1$ is actuated. At the same time, contact of the limit switch 350 opens to release the relay $X_4$ from being kept latched on. The contact of the relay $X_2$ closes to actuate an electromagnetic valve 309A whereby the piston rod 310 of the pneumatic cylinder 309 is caused to retract and, thus, as already stated, the horizontally held chesses 1 by pairs of the bobbin holders 313*a*, 313*b* are caused to turn to a vertical direction. Further, the electromagnetic vlave 341B is deenergized by the opening of the relay $X_4$, and thus, the piston rod 342 of the pneumatic cylinder 341 is stopped at that position. Thereafter, the timer $T_1$ setting a timer $t_1$ sufficient for the horizontally held cheeses to turn to a vertical direction, trips to open its contact thereby to release the relay $X_3$ from being latched on. As a result, the electromagnetic valve 315A is deenergized and the cheeses 1 are released from being held by the bobbin holder, namely the cheeses 1 become such a condition that they are merely placed on the lift 3.

Then the feeder 6 starts to operate to hold and raise the cheeses 1. A relay $Y_2$, which will be further described hereinafter, is actuated in order to start the rightward movement (in FIG. 1) along the rail 5 of the feeder 6 holding the cheeses 1.

Contact of a relay $Y_6$ then opens to release the relay $X_2$ from being kept latched on and, the timer $T_1$ stops operating and returns to its original condition. By the opening of the relay $X_2$ the electromagnetic valve 309A is deenergized whereby the piston rod 310 of the pneumatic cylinder 309 is caused to project therefrom and the bobbin holder returns to a horizontal direction. At the same time, contact of the relay $Y_6$ closes to actuate the relay $X_5$ and keep it latched on. The closing of contact of the relay $X_5$ actuates the electromagnetic valves 341A and 341B, whereby the piston rod 342 of the pneumatic cylinder 341 is retracted to cause the slide block 303 to descend. Further, the opening of contact of the relay $X_5$ releases the relay $X_9$ from being kept latched on and deenergizes the electromagnetic valve 320A, whereby the piston rod 323 of the pneumatic cylinder 320 is retracted to cause the bobbin holders to turn to an oblique direction from their horizontal condition. Since the relay $X_6$ is still operating and the electromagnetic valve 348A is still actuated, the piston rod 349 of the pneumatic cylinder 349 is retracted thereinto and, since the stopper 347 remains retracted into the rail 5, the slide block 303 is caused to descend to the lowermost level.

When the limit switch 352 closes, the relays $X_1$ and $X_8$ operate, and contact of the limit switch 352 opens to release the relay $X_5$ from being kept latched on. The opening of the relay $X_5$ deenergizes the electromagnetic valves 341A and 341B, whereby the piston rod 342 of the pneumatic cylinder 341 stops the descending motion. That is, the descending motion of the slide block 303 is stopped. The relay $X_8$ is then caused to wait in a state that it is kept latched on. By means of the relay $X_1$ the abovementioned operations carried out with the slide block 303 at the intermediate level are now repeated with the slide block 303 at the lowermost level. Similarly, the slide block 303 is then raised to the uppermost level and the limit switch 350 operates. The operations for transferring the cheeses of the lift 3 to the feeder 6 are again repeated. At this time, however, the relay $X_7$ operates since the relay $X_8$ is still operating. Thus, the relay $X_6$ is released from being kept latched on and the electromagnetic valve 358A is deenergized, whereby the piston rod 349 of the pneumatic cylinder 348 is projected therefrom to cause the stopper 347 to project from the rail 5. Accordingly, while the slide block 303 starts to descend by the similar operations as mentioned hereinbefore after having transferred the cheeses 1 to the feeder 6, the descendent motion does not extend below the intermediate level. Furthermore, the relay $X_6$ together with the limit switch 351 releases the relay $X_5$ from being kept latched on and deenergizes the electromagnetic valves 341A and 341B to stop the retraction of the piston rod 342 of the pneumatic cylinder 341. The slide block 303 is now kept at the intermediate level and waits for the arrival of another transportation truck 2. Upon the arrival of such a truck 2 carrying fresh cheeses the push button switch PB is caused to close, the relay $X_8$ is released from being kept latched on, the circuit conditions are reset and the operations as mentioned above are repeated.

A second mechanism for receiving the cheeses 1 from the lift and for transporting these cheeses 1 into a carton box is hereinafter explained in detail. As shown in FIGS. 1 and 2, this second mechanism comprises a horizontal rail 5 supported by a pair of pillars 4*a* and 4*b* at a position above the lift 3, a feeder 6 which is displaceably mounted on the horizontal rails 5 and a chain driving mechanism 7 for displacing the feeder 6 to anyone of the predetermined positions with respect to the horizontal rail 5. In this embodiment, a device 8 (FIGS. 1 and 2) for feeding a partition plate is also mounted on the horizontal rail 5 and this device 8 is capable of displacing along the rail 5 by means of the above-mentioned chain driving mechanism 7. The feeder 6 is provided with a horizontal lifting plate 602 and a lifting pneumatic cylinder 601 which is capable of displacing the lifting plate 602 along a vertical passage thereof as shown in FIGS. 1 and 2. A group of a plurality bobbin holding devices is disposed on the lifting plate 602.

The driving mechanism 7 comprises a driving motor 9 and a driving control device 10 so as to drive an endless chain 503 (FIGS. 14 and 15A) with which a feeder body proper 600 is engaged. Consequently, the feeder 6 is capable of displacing along the rail 5 at a position above the lift 3 and of stopping at a predetermined position indicated by a solid line in FIG. 1.

Figure 9A:
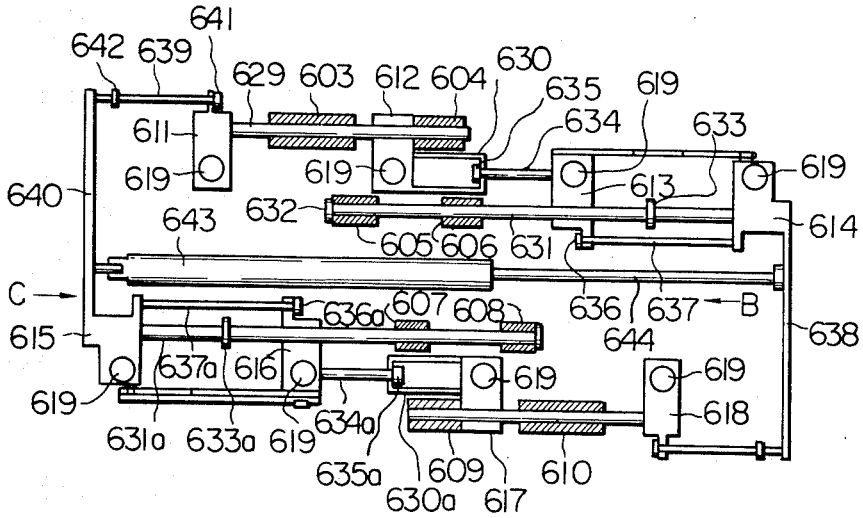
FIG. 9A and 9B are schematic elevational views of the mechanism for changing the arrangement of the bobbin supporting members of the feeder shown in FIG. 1.
Figure 9B:
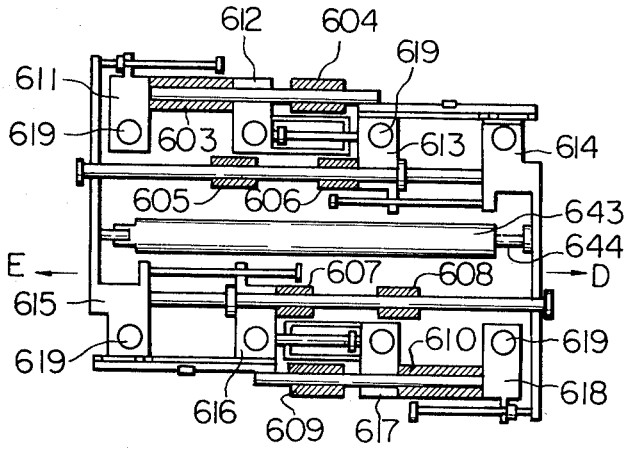
Figure 10A:
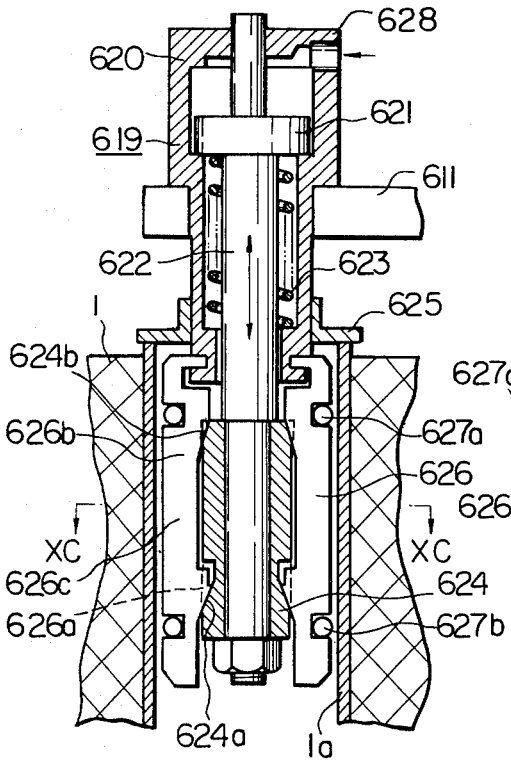
FIGS. 10A and 10B are sectional views of the bobbin supporting member mounted on a feeder shown in FIG. 1.
Figure 10B:
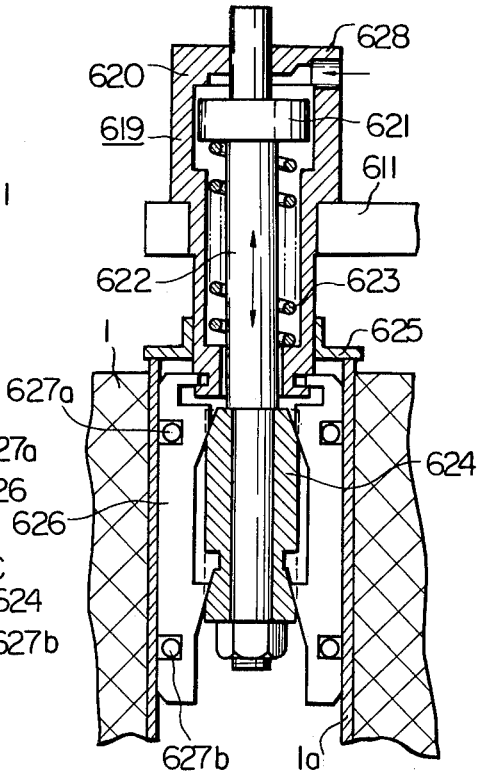
Figure 10C:
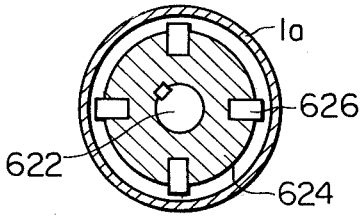
FIG. 10C is a cross-sectional view of the bobbin supporting member taken along line XC in FIG. 10A.

The lifting air cylinder 601 is actuated to bring down the lift plate 602 by a predetermined distance. Bearings 603 to 610 are rigidly mounted on the lower portion of the lifting plate 602 in an arrangement such as shown in FIGS. 9A and 9B. Bobbin supporting members 619 as shown in FIGS. 10A and 10B are rigidly mounted on supporting member holding plates 611 to 618 which are supported by the above-mentioned bearings 603 to 610, respectively, through an arrangement-changing mechanism described hereinafter with reference to FIGS. 9A and 9B. The basic construction and function of the bobbin supporting members 619 with respect to the supporting member holding plates 611, 612, 613, 614, 615, 616, 617 and 618 are identical and, therefore, for the sake of simplification of the specification, only the illustration of the bobbin supporting member 619 secured to the supporting member holding plate 611 will be explained. The bobbin supporting member 619 comprises a pneumatic cylinder 620 provided with a piston 621 and a piston rod 622, a helical expansion spring 623 is disposed in the cylinder 620 in such a way that the piston 621 is always urged upwardly. A cylindrical control body 624 is rigidly mounted on the lower end portion of the piston rod 622 and a bobbin anchoring ring 625 is fixed to the lower end portion of the cylinder 620. The cylindrical control body 624 is provided with four vertical guide grooves **624*a* formed symmetrically with respect to the longitudinal axis thereof at a lower portion of the peripheral surface thereof, and each groove 624*a* is provided with a guide surface which inclines outwardly toward the downward direction. The cylindrical control body 624 is also provided with four vertical grooves 624*b* formed symmetrically with respect to the longitudinal axis thereof at a top end portion of the peripheral surface thereof, and each groove 624*b* is provided with a guide surface which inclines outwardly toward the downward direction. These grooves 624*a* and 624*b* are formed in such a way that there are four pairs of guide grooves, each pair comprising one of the guide grooves 624*a* and one of the guide grooves 624*b* and these guide grooves as a pair are aligned in parallel to the lengthwise direction of the piston rod 622. A bobbin holding plate 626 is disposed on each of the pairs of the guide grooves 624*a* and 624*b* as shown in FIGS. 10A, 10B, and 10C, and these holding plates 626 are resiliently bound by elastic members 627*a* and 627*b*. Each holding plate 626 is provided with a pair of inwardly projected inclined portions 626*a* and 626*b*. These projected inclined portions 626*a* and 626*b*, and an intervened portion 626*c* are fitted on the inclined guide surfaces of the respective guide grooves 624*a*, 624*b* and the outer-surface of the control body 624, when the piston rod 622 is projected from the pneumatic cylinder 620. When the pneumatic cylinder 620 is de-energized, the piston 621 is displaced upward by the expansion force of the helical spring 623 so that the rod 622 is displaced upward. The projected portions 626*a*, 626*b* of every holding plate 626 slide on the respective outwardly incline portion of the corresponding guide grooves 624*a* or 624*b*, by the relative displacement of the piston rod 622, that is, the cylindrical control body 624 and the holding plates 626. According to the above-mentioned motion, the holding plates 626 are laterally displaced in a condition against the binding force of the elastic members 627 as shown in FIG. 10B.**

The operation of the bobbin supporting member 619 having the above structure will now be described. Compressed air is introduced from an opening 628 formed in the upper portion of the cylinder 620 through a piping and an electromagnetic valve, neither being shown in the drawing. By the action of the compressed air the piston 621 and piston rod 622 are forced down. Since the control body 624 is simultaneously lowered, the bobbin holding plates 626 are forced inwardly by the elastic members 627 and the bobbin supporting member 619 is put in the closed state as shown in FIG. 10A. In this condition, the bobbin supporting member 619 is inserted into the interior of the bobbin **1*a* of the cheese 1 supported in the upright condition by the lift 3 when the lift plate 602 is displaced downward. When the electromagnetic valve (not shown) is then changed over and the compressed air in the cylinder 620 is discharged, the piston 621 and piston rod 622 are moved upwardly by the action of the helical spring 623. Since the control body 624 is simultaneously moved upwardly with the rod 622, the inwardly projected inclined portions 626*a* and 626*b* of the bobbin holding plates 626 are engaged with the outwardly inclined guide grooves 624*a* and 626*b* of the control body 624 so that the bobbin holding plates 262 are outwardly shifted against the force of the elastic members 627. Namely, the bobbin supporting member 619 is put in the opened state as shown in FIG. 10B to support the bobbin 1*a*.**

Then, the lifting air cylinder 601 is operated in the reverse direction to lift up the lifting plate 602 a certain distance. In this state, respective cheeses 1 are arranged in zigzags as shown in FIG. 9A with respect to the bobbin supporting members 619, and the distance in the longitudinal direction between two adjacent cheeses 1 is the same as the distance in the lateral direction between two adjacent pegs in the transporting truck 2. Namely, of the distances between two adjacent alignments of the cheeses 1 and between two adjacent rows of the cheeses 1, each of which was relatively broad in the transporting truck 2, only the distance between two adjacent alignments of the cheeses 1 is reduced by the above-mentioned width-contracting action of the lift 3.

This arrangement of the cheeses 1 must be changed to a compact network approximating the arrangement in the packaged condition, namely, the arrangement shown in FIG. 9B with respect to the bobbin supporting members 619. An arrangement changing mechanism for effecting this change of the arrangement will now be described with reference to FIGS. 9A and 9B.

The supporting member holding plate 611 is secured to one end of a slide shaft 629 slidably supported by the bearings 603 and 604. The supporting member holding plate 612 is mounted slidably on the slide shaft 629 between the bearings 603 and 604 and a pair of engaging guides 630 are fixed to the supporting member holding plate 612. The supporting member holding plate 614 is fixed to one end of a slide shaft 631 slidably supported by the bearings 605 and 606, and a stopper 632 is fixed to the other end of the slide shaft 631. A pusher 633 is disposed in the intermediate portion of the slide shaft 631. The supporting member holding plate 613 is mounted slidably on the slide shaft 631 between the bearing 606 and the pusher 633, and a shaft 634 sliding in one of the pair of the engaging guides 630 is mounted on the supporting member holding plate 613. An anchoring member 635 anchoring the engaging guide 630 on the top end thereof is attached to the shaft 634. A shaft 637 provided with an anchoring member 636 formed on the top end thereof is fixed to the supporting member holding plate 614, and also a moving plate 638 is fixed to the plate 614. The shaft 637 is arranged so that the shaft 637 slides on a part of the supporting member holding plate 613, and a part of the supporting member holding plate 613 is anchored by the anchoring member 636. an anchoring member 641 is fixed to the top end of the shaft 639 to anchor a part of the supporting member holding plate 611, and a pusher 642 is fixed to the intermediate portion of the shaft 639. Free ends of a pneumatic cylinder 643 and a rod 644 of the pneumatic cylinder 643 are fixed to the moving plates 638 and 640, respectively. In the normal state, the rod 644 of the pneumatic cylinder 643 is elongated as shown in FIG. 9A. The supporting member holding plates 615, 616, 617 and 618 have the same mechanism as mentioned above and are connected to the moving plates 638 and 640 in a direction reverse to the above-mentioned direction. Consequently, a detailed explanation thereof is omitted.

The operation of the arrangement changing mechanism having the above mentioned structure will now be described. At first, the pneumatic cylinder 643 is actuated so as to retract the rod 644 thereinto and move the moving plates 638 and 640 in directions indicated by arrows B and C in 9A, respectively. Thus, the supporting member holding plate 614 is moved in the direction of arrow B and the shaft 639 is moved in the direction of arrow C. Of course, also the slide shaft 631 secured to the supporting member holding plate 614 is moved in the same direction as the moving direction of the plate 614. Then, each of the moving plates 638 and 640 is moved a predetermined distance, and at this point, the pusher 633 secured to the slide shaft 631 falls into contact with the supporting member holding plate 613 and the pusher 642 secured to the shaft 639 falls into contact with the supporting member holding plate 611. The pushers 633 and 642 then begin to move together with the slide shaft 631 (namely, the moving plate 638) and the shaft 639 (namely, the moving plate 640), respectively. The shaft 634 secured to the supporting member holding plate then 613 begins to move in the same direction as the slide shaft 631. When the rod 644 is further retracted into the cylinder 643 and the moving plates 638 and 640 are further displaced, the supporting member holding plate 611 falls into contact with the bearing 603 and is fixed thereby, and consequently, the anchoring member 635 falls into contact with the supporting member holding plate 612 and the plate 612 begins to move. When the rod 644 is further retracted into the pneumatic cylinder 643 to move the moving plate 638, the supporting member holding plates 612 and 613 fall into contact with the bearings 603 and 606, respectively, and the motion thereof is stopped. In the same manner as described above, the supporting member holding plates 615, 616, 617 and 618 are moved in a direction reverse to the moving direction of the above mentioned supporting member holding plates. Therefore, the detailed explanation of these plates 615 to 618 is omitted.

In the foregoing manner, the arrangement of the supporting member holding plates 611 to 618 is changed from the condition shown in FIG. 9A to the condition shown in FIG. 9B. Namely, the spacing between cheeses 1 of each alignment in the longitudinal direction is reduced and the zigzag arrangement is changed to a parallel lattice arrangement.

The cheeses 1 in the above arrangement condition are loaded into a cardboard or similar box 11 by a loading operation described hereinafter, and bobbing holding members 619 from which the cheeses 1 are separated, are arranged in zigzags and the spacing thereof is expanded to the standby condition for the next cycle of operation. This operation is described hereinafter.

In the arrangement changing mechanism in the condition shown in FIG. 9B, the pneumatic cylinder 643 is reversely operated to project the rod 644, and the moving plates 638 and 640 are moved in directions indicated by arrows D and E in FIG. 9B, respectively, whereby the supporting member holding plate 614 is moved in the direction of arrow B′ and the shaft 639 is moved in the direction of arrow C′. The slide shaft 631 and shaft 637 fixed to the supporting member holding plate 614 are also moved in the same direction as the moving direction of the plate 614. When each of the moving plates 638 and 640 has moved a predetermined distance, the anchoring member 636 secured to the top end of the shaft 637 anchors a part of the supporting member holding plate 613 and the anchoring member 641 secured to the top end of the shaft 639 anchors a part of the supporting member attachment plate 611, and these anchoring members 636 and 641 begin to move together with the shaft 637 (namely, the moving plate 638) and the shaft 639 (namely, the moving plate 640), respectively. Then, the slide shaft 629 secured to the supporting member holding plate 611 and the shaft 634 secured to the supporting member holding plate 613 begin to move in the same direction as the moving plate 640 and the moving plate 638, respectively. When the rod 644 is further projected from the pneumatic cylinder 643 so as to move the moving plates 638 and 640, the supporting member holding plate 611 is further moved in the same direction as the motion of the rod 644 and the anchoring member 635 on the top end of the shaft 634 secured to the supporting member holding plate 613 anchors a pair of engaging guides 630 secured to the supporting member holding plate 612, whereby the supporting member holding plate 612 is caused to begin to move in the same direction (namely, the direction of arrow B′ in FIG. 9B). When the rod 644 is further projected from the pneumatic cylinder 643 so that the moving plates 638 and 640 are further displaced, the supporting member holding plate 612 falls into contact with the bearing 604 and the displacement thereof is stopped thereby. Simultaneously, the anchoring member 632 secured to the top end of the slide shaft 631 falls in contact with the bearing 605 to fix the position of the supporting member holding plate 614. Namely, the motion of the moving plate 638 is stopped. Since the displacement of the moving plate 640 is performed by the supporting member holding plates 615, 616, 617 and 618 in the same manner as mentioned above, except that the moving direction is reverse to the moving direction of the moving plate 638, the displacement of the moving plate 640 is stopped simultaneously with stopping of the displacement of the moving plate 638.

By the above-mentioned operation, the arrangement of the supporting member holding plates 611 to 618 is changed from the standby condition shown in FIG. 9B to the condition shown in FIG. 9A.

The cheeses 1 which are supported in the above-mentioned rearranged condition by the feeder 6 are loaded in the cardboard box 11. The mechanism for performing this loading operation and the function of this mechanism is hereinafter explained.

Figure 2:
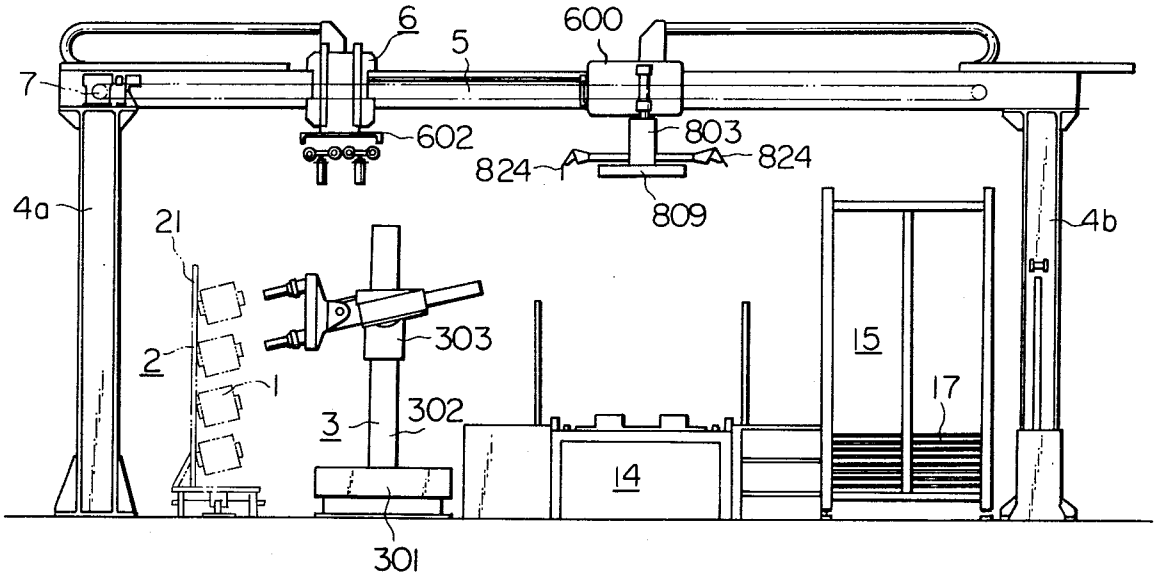
FIG. 2 is a schematic side view of the packaging apparatus shown in FIG. 1.

Referring to FIG. 1, the cardboard box 11 placed on a transportation rail 12 is transported below the rail 5 by pushing it. Simultaneously, a stopper (not shown) is actuated to stop the displacement of the cardboard box 11 precisely at a predetermined position and a pallet lifting device 14, detailed hereinafter, is slightly lifted up to separate the cardboard box 11 from the belt 12. The cardboard box 11 comprises a box proper 111 of corrugated cardboard or the like, nine spacers 113 attached in a checkered pattern to the bottom of the box proper 111 through a plate 112 and three supporting plates 114 each of which supports one row of the spacers 113, namely, three aligned spacers 113. The space between two adjacent spacers 113 is determined so as to facilitate succh operations as banding the cardboard box 11 and transporting the cardboard box 11 by a fork lift or the like. The supporting plates 114 are utilized to protect the spacers 113 during transportation by rollers or the like. The box proper 111 includes a square bottom on which about four cheeses 1 can be placed in an alignment and walls having a height a little higher than that of two cheeses 1 vertically superposed.

A device 8 for supplying a partition plate 17 is mounted on the rail 5 in such a condition that the device is capable displacing along a passage between two positions right above the loading position of the feeder 6 and a stand 15 for reserving partition plates 17. The device 8 is provided with a pneumatic cylinder 801 and the pneumatic cylinder 801 is provided with a piston rod 802. A partition plate reserving mechanism is mounted on a bottom end of the piston rod 802. This mechanism is operated to support a partition plate 17. The lifting pneumatic cylinder 801 is then operated in the reverse direction to retract the rod 802 into the cylinder 801. Then, the driving motor 9 and driving control device 10 (FIGS. 14, 15A and 15B) are actuated to drive only a chain (not shown) which is connected to the body 800 of the device 8, whereby the device 8 is displaced to a position right above the pallet lifting device 14, and the device 8 is stopped at a predetermined position. Then, the pneumatic cylinder 801 is actuated again to project the rod 802 and the pallet lifting device 14 is operated by a lifting mechanism, hereinafter described, to lift up the cardboard box 11 on the lifting device 14. The partition plate supporting mechanism is then reversely operated to release the support of the partition plate 17, and the partition plate 17 is placed on the bottom of the cardboard box 11. While the pallet lifting device 14 is actuated to return to its standby condition, the above-mentioned driving motor 9 and driving control device 10 are reversely operated to drive the chain (not shown) connected to the body 800 of the device 8 so that the partition plate feeding device 8 is returned onto the partition plate feed stand 15. By this reverse operation of the driving motor 9 and driving control device 10, the chain (not shown) connected to the feeder proper 600 is simultaneously driven to displace the body 600 of the feeder 6, which supports the cheeses 1 in the above-mentioned arrangement-changed condition, to a position right above the pallet lifting device 14 and the body 600 is stopped at a predetermined position. Then, the pallet lifting device 14 is actuated again to lift up the cardboard box 11 to a predetermined position and, simultaneously, the lifting pneumatic cylinder 601 of the feeder 6 is actuated to lower the lift plate 602 (namely, the cheeses 1) to a predetermined position, whereby each of supporting caps, described later, of the partition plate 17 is inserted into the interior of the bobbin 1*a* of the corresponding cheese 1. At this point, the bobbin supporting members 619 of the feeder 6 are actuated by the introduction of compressed air from the opening formed in the upper portion of the pneumatic cylinders 620 to release the holding of the cheeses 1. Accordingly, the cheeses 1 are placed on the partition plate 17 in the cardboard box 11. Thereafter, the pallet lifting device 14 is lowered again and the feeder 6 is shifted again to a predetermined position above the lift 3 by the driving motor 9 and drive control device 10. At this point, the lift 3 is caused by the above mentioned arrangement changing mechanism to arrange the bobbin supporting members 619 in zigzag condition again and expand the spacing between two adjacent supporting members 619. Simultaneously with the above-mentioned operation, the slide block 303 of the lift 3 is brought down to the position corresponding to the lower two stages of the cheeses 1 in the transporting truck 2 and, by an operation similar to the above-mentioned operation of the lift 3, the slide block 303 takes out eight cheeses 1 from the transporting truck 2 and narrows the spacing between the two alignments of the cheeses 1. Then, the supporting plate 308 is turned to support the cheeses 1 in upright condition, and the slide block 303 is displaced to the predetermined upper most position on the slide guide shaft 302.

Figure 11:
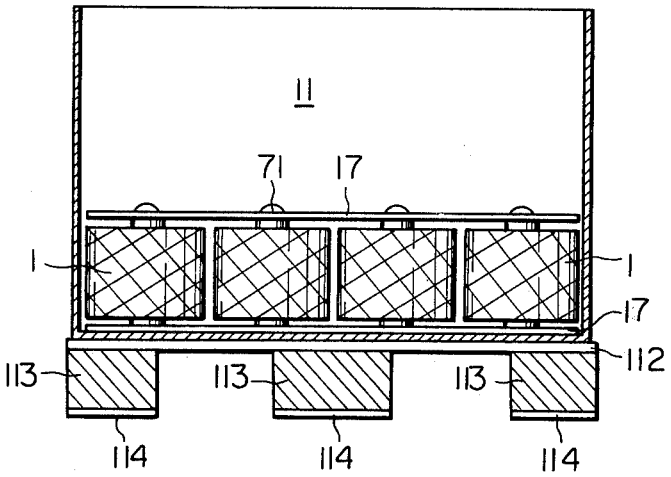
FIG. 11 is a sectional view showing the placement of the lower group of cheeses in the box.
Figure 7:
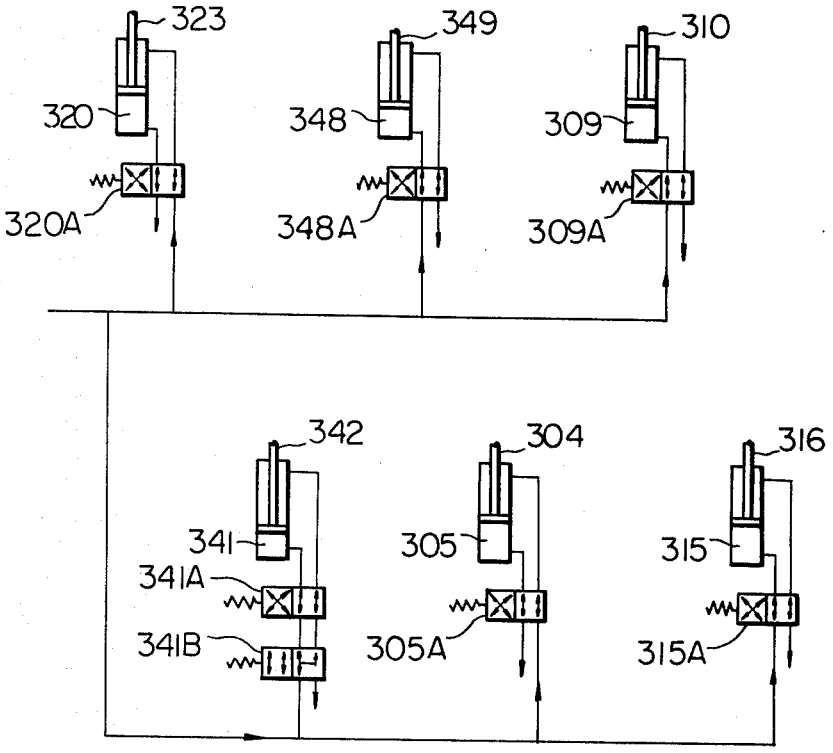
FIG. 7 is a schematic diagram of a pneumatic circuit for operating pneumatic cylinders utilized for the lift shown in FIG. 1.

Then, by an operation similar to the above-mentioned operation, the feeder 6 transfers the cheeses 1 on the partition plate 17 in the cardboard box 11 so that a lower group of cheeses 1 are placed on the plate 17 as shown in FIG. 11. Each time the feeder 6 repeats the above-mentioned operation twice, the above-mentioned operation of the partition plate feed device 8 is conducted once. In connection with the operation of the partition plate feed device 8, a slider 16 engaged with the chain (not shown) driven by the driving motor 9 and driving control device 10, and attached slidably to the pillar 4*b,* is lifted up a predetermined distance, so that the uppermost partition plate 17 in the partition plate feed stand 15 can be always reserved at the uppermost predetermined position.

Different types of the partition plates 17 are utilized for the embodiment of the apparatus mentioned above. That is, a first type of partition plate is utilized as a partition plate positioned directly on the bottom of the cardboard box 11, a second type is utilized as a partition plate positioned directly on the group of cheeses 1 positioned at the uppermost position of the cardboard box 11, and a third type is utilized as a partition plate positioned between two groups of the cheeses 1 disposed in the cardboard box 11. Referring to FIGS. 12A through 12D the above-mentioned first and second partition plates 17 are comprised of a plate proper 72 and a cap 71 secured to the plate proper 72. The relative arrangements of the caps 71 in connection with the plate proper 72 with respect to the above-mentioned first partition plate 17*a* or second partition plate 17*b* are reverse to each other. That is, in the above-mentioned first partition plate 17*a,* the cap 71*a* is projected upwardly from the plate proper 72 as shown in FIG. 12C, while in the above-mentioned second partition plate 17*b,* the cap 71*b* is projected downwardly from the plate proper 72. In the above-mentioned third partition plate 17, a pair of caps 71*a* and 71*b,* are projected from the plate proper 72 in reverse directions respectively as shown in FIG. 12B.

Figure 12A:
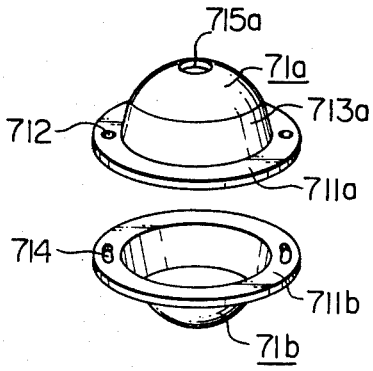
FIG. 12A is a perspective view of a pair of caps utilized for a partition plate utilized for packaging according to the present invention.
Figure 12B:
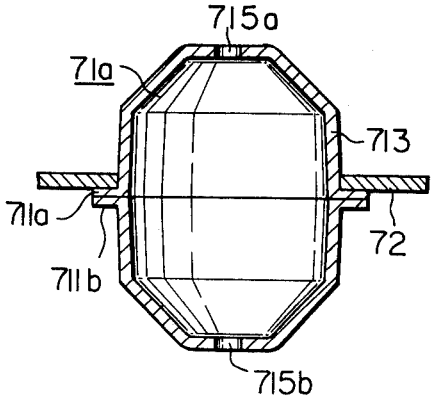
FIG. 12B and 12C are sectional views of a partition plate on which a cap (or a pair of caps) is rigidly mounted.

A schematic perspective view of the caps 71*a* and 71*b* are shown in FIG. 12A. For the sake of a better understanding of the invention, the above-mentioned caps 71*a*, 71*b* are hereinafter, referred to as a upper supporting cap 71*a* and an lower supporting cap 71*b* respectively.

Figure 12D:
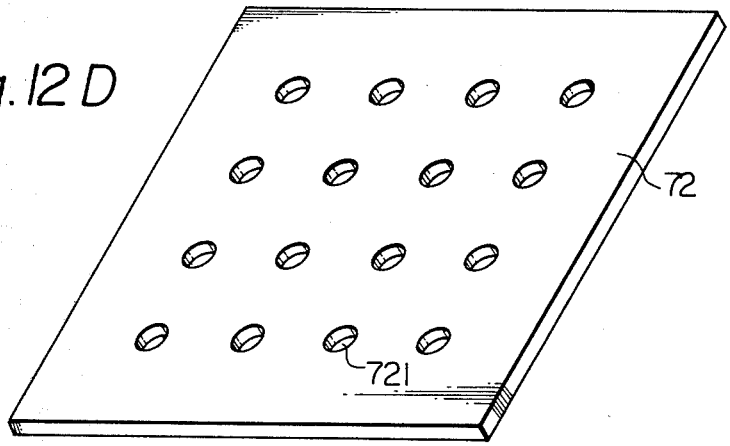
FIG. 12D is a partition plate utilized for packaging according to the present invention.
Figure 12C:
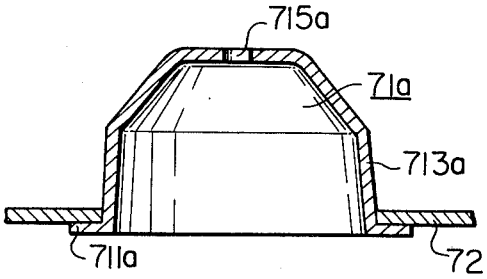

The upper supporting cap 71*a* has a pair of holes 712 in a flange portion 711*a* and a cylindrical portion 713*a*, the outer diameter of which is almost equal to the inner diameter of the lower portion of the bore of the bobbin 1*a* of the cheese 1. The lower supporting cap 71*b* has a flange portion 711*b* with a pair of projections 714 thereon, formed at positions corresponding to the apertures 712, and a cylindrical portion 713*b* with an outer diameter which is almost equal to the inner diameter of the upper portion of the bore of the bobbin 1*a* of the cheese 1. If the inner diameter of the bobbin 1*a* of the cheese 1 is equal in the upper and lower bore portions thereof, it is possible to interchange the upper supporting cap 71*a* and the lower supporting cap 71*b*. Each of the upper supporting cap 71*a* and the lower supporting cap 71*b* has an aperture 715 on the top thereof. A fixing rod (not shown) for positioning is inserted into this aperture 715 when the supporting cap 71 is reserved or if it is intended to position the partition plate 17 more precisely in the partition plate feed stand 15. As shown in FIG. 12D, the plate proper 72 of the partition plate 17 has a square form such that it can be freely inserted in the interior of the cardboard box 11 with a certain clearance. The plate proper 72 is provided with apertures 721 arranged in a regular lattice of four rows and four alignments, each aperture 721 having a diameter slightly smaller than the outer diameter of the cylindrical portion 713*a* or 713*b* of the supporting cap 71*a* or 71*b*. It is preferred that the plate proper 72 be made of a formed styrol resin or other synthetic resin and be elastic to some extent.

As mentioned above, the partition plate 17 to be positioned at the bottom of the cardboard box 11 is formed by inserting only the upper supporting cap 71*a* into the corresponding apertures 721 of the plate proper 72. Since the diameter of the aperture 721 is slightly smaller than the outer diameter of the cylindrical portion 713*a* of the supporting cap 71*a* and the plate proper 72 is made of an elastic material, the caps 17*a* can easily be supported by the partition plate 17 only by inserting into any aperture 721.

The partition plate 17 to be located at the uppermost part of the cardboard box 11 is similarly formed by inserting the lower supporting cap 71*b* into the corresponding aperture 721. Even if there is some difference between the outer diameter of the cylindrical portion 713*a* of the upper supporting cap 71*a* and the outer diameter of the cylindrical portion 713*b* of the lower supporting cap 71*b*, since the plate proper 72 is elastic to some extent, the diameter of the aperture 721 need not be made different between the lowermost plate and the uppermost plate. Namely, plate propers 72 having apertures 721 of equal diameter can be used for both the bottom and top partition plates 17 of the cardboard box 11.

In the partition plate 17 to be located in the intermediate portion of the cardboard box 11, the projections 714 of the lower supporting cap 71*b* is inserted into the apertures 712 of the upper supporting cap 71*a*, and an adhesive is coated on the confronting surfaces of the flanges 711*a* and 711*b*. While both the flanges 711*a* and 711*b* are thus bonded together, the upper supporting cap 71*a* bonded to the lower supporting cap 71*b* is inserted into the corresponding aperture 721 of the plate proper 72.

A plurality of sets of partition plates 17, each set including five of the so prepared partition plates 17 (the cheeses 1 are positioned in four layers) are loaded on the partition plate feed stand 15. In each set, the partition plates 17 are arranged in such an order that the partition plate 17 to be located at the bottom of the cardboard box 11 is on the top of each set of the plates 17, while the partition plate 17 to be located at the top of the cardboard box is on the bottom of each set of the plates 17. The partition plates 17 with the upper and lower supporting caps arranged as shown in FIG. 12B are between the above-mentioned two partition plates 17. The partition plate feed stand 15 comprises four L-shaped pillars 151; a base plate 153 sliding on the L-shaped pillars 151; three spacers 152 disposed on the lower portion thereof in a condition spaced from one another as shown in FIG. 1, and; a stopper (not shown) for preventing free sliding of the base plate 153 so that the base plate 153 is moved down from a certain position during transportation or when the sliding of the plate 153 is not required.

A plurality of sets of the partition plates 17 prepared in other place are mounted on the partition plate feed stand 15, and then the base plate 153 is fixed by certain fastening member (not shown). Then, the partition plate feed stand 15 is displaced to a predetermined position right below the rail 5 on the slider 16 by suitable transportation means such as a fork lift. The spacers 152 are disposed into the stand 15 in such an order positioning at the bottom of a set of partition plates. Then, the base plate 153 is released from the fastening member, whereby the preparation for feeding the partition plates 17 is completed, while the base plate is kept in a freely slidable condition. When the sider 16 is lifted up with the operation of the partition plate feed device 8 in the above-mentioned manner, the base plate 153 is lifted up a predetermined distance.

Figure 13A:
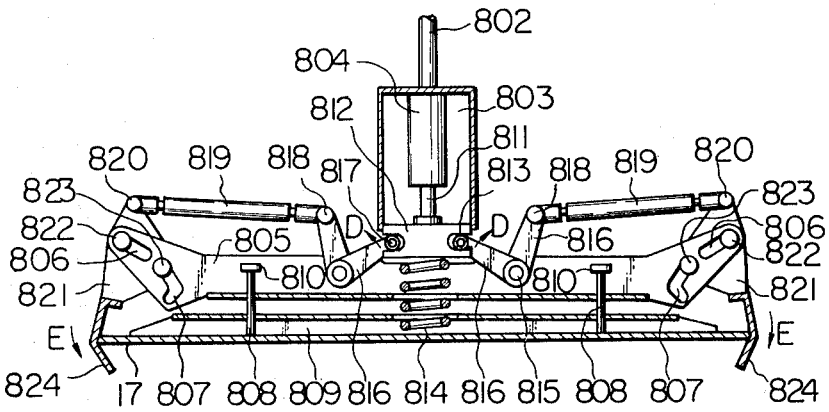
FIG. 13A and 13B are side views, partly in section of the mechanism for reserving a partition plate, which is mounted on the partition plate feed device 8 shown in FIG. 1.
Figure 13B:
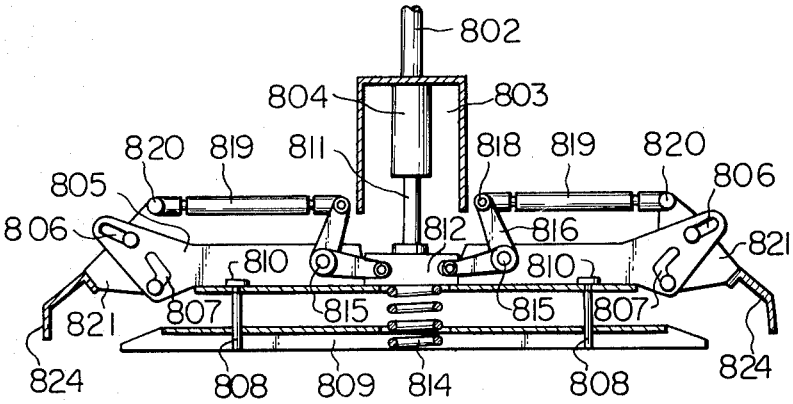

The mechanism for holding partition plates 17 provided in the partition plate feed device 8 is hereinafter explained with reference to FIGS. 13A and 13B.

A cylindrical body 803 is secured to a rod 802 of a lifting pneumatic cylinder 801 disposed in the body 800 of the partition plate feed device 8 (FIG. 1). A partition plate supporting pneumatic cylinder 804 is secured to the cylinder body 803. A guide groove 806 and an L-shaped guide groove 807 are formed on each of the side end portions of the guide plate 805, and a moving plate 809 is slidably engaged with shafts 808. An anchoring projection 810 is mounted on the other end of each slide shaft 808 so that the moving plate 809 is prevented from falling away from the guide plate 805. A sliding plate 812 is secured to the partition plate supporting pneumatic cylinder 804 through a rod 811. There are formed sliding grooves 813 on four sides of the sliding plate 812 and the sliding plate 812 is connected to the moving plate 809 through a spring 814. Guide pins 817 are slidably inserted in the sliding grooves 813. Each guide pin 817 is mounted on one end of an L-shaped lever 816 disposed rotatably on the guide plate 805 through a pin 815. A rod 819 is rotatably hinged to the other end of each L-shaped lever 816 through a pin 818. A rotary plate 821 is rotatably hinged to the other end of each rod 819 through a pin 820. Pins 822 and 823 sidably inserted in the guide grooves 806 and L-shaped guide groove 807 are attached to the rotary plates 821, and supporting plates 824 are secured to the rotary plates 821.

The operation of the partition plates supporting mechansim is not described. Referring now to FIG. 13B illustrating the condition before holding a partition plate 17, the lifting pneumatic cylinder 801 is actuated to project the rod 802. By this operation, the moving plate 809 is caused to fall into contact with the partition plate 17. Substantially simultaneously, the supporting pneumatic cylinder 804 is operated to retract the rod 811 into the cylinder 804 and lift up the sliding plate 812 together with the guide plate 805. Accordingly, the guide pins 817 are caused to slide in the slide grooves 813 and the L-shaped levers 816 are turned in a direction indicated by arrows D in FIG. 13A. This turning of the L-shaped levers 816 causes the rotary plates 821 to turn through the rods 819. Since the pins 822 and 823 are slidably inserted in the guide grooves 806 and L-shaped guide grooves 807, the rotary plates 821 are turned in a direction indicated by arrows E in FIG. 13A while lifting up its position. Accordingly, it is possible to diminish remarkably the moving space (especially the moving space in the lateral direction) for the turning of the supporting plates 824 secured to the rotary plates 821. The partition plate 17 is supported in the above-mentioned manner, and this supported condition is shown in FIG. 13A. Release of the holding of the partition plate 17 is accomplished by an operation reverse to the above-mentioned operation. This releasing operation will be apparent to those skilled in the art even if it is not explained in detail. When the partition plate 17 is supported in the interior of the cardboard box 11, if the distance of movement of the rod 811 for the reverse operation of the supporting pneumatic cylinder 811 is diminished and the rod 811 is forcibly pulled downwardly by the elastic force of the spring 814, good results are obtained because the moving space of the supporting plates 824 is remarkably diminished.

Figure 14:
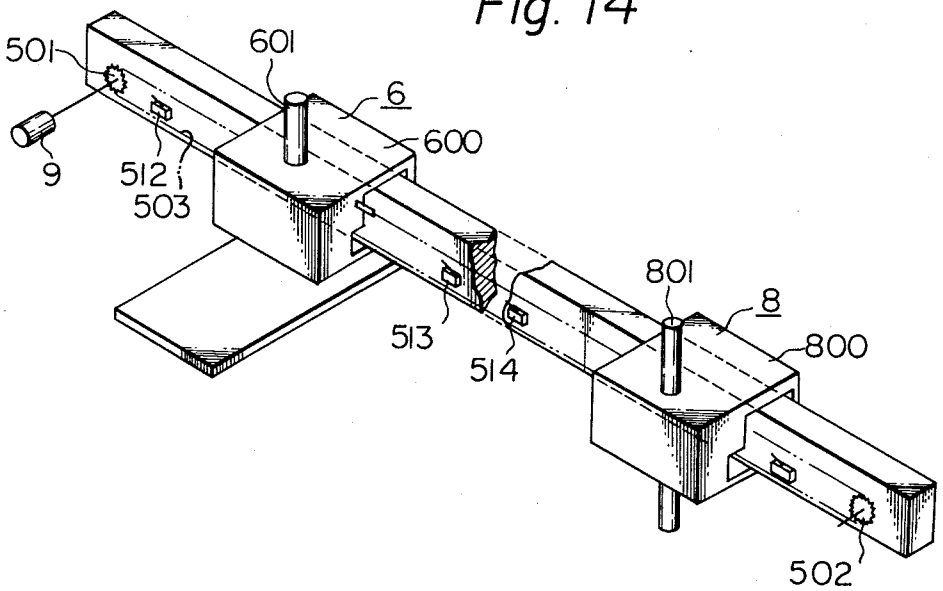
FIG. 14 is a perspective view of a mechanism for displacing the feeder and the partition plate feed device 8 shown in FIG. 1.

Mechanism for displacing the feeder 6 and the partition plate feeding device 8 is hereinafter explained with reference to FIGS. 14, 15A and 15B.

A pair of sprocket wheels 501 and 502 are rotatably mounted on the horizontal rail 5 at the respective positioned adjacent to the longitudinal ends thereof. The sprocket wheel 501 is driven by a driving motor 9 by way of a driving speed control device 10 which involves a speed changing means, and clutch means. A chain 503 is mounted on the sprocket wheels 501 and 502 and the both ends thereof are connected to the feeder proper 600 so that the feeder proper 600 is capable of displacing along the rail 5 by means of driving the sprocket wheel 501. Three limit switches 512, 513 and 514 are mounted on the rail 5 at a first position $P_1$ which corresponds to a position right above the lift 3, a second position $P_2$ which corresponds to a position right above two alignments of the caps 71*a* (or 71*b*), a third position $P_3$ which corresponds to a position right above the other two alignments of the caps 71*a* (or 71b). A solid stopper 504 and a pair of stoppers 506 and 509, which are capable of projecting outside the rail 5, are mounted on the rail so as to position correctly the feeder 6 at at the above-mentioned first, second and third positions $P_1$, $P_2$, $P_3$ respectively. The stoppers 506, 509 are pivotably mounted in recessed portions of the rail 5 and have an identical construction and function, that is, each of them is capable of being projected from the recess by means of their respective pneumatic cylinders 507, 510. The pneumatic cylinder 507 is provided with a rod 508 which is connected to a tip portion of the stopper 506, while the pneumatic cylinder 510 is provided with a rod 511 connected to a tip portion of the stopper 509. A bearing member 505 is rigidly mounted on the rail 5 at a position corresponding to the body proper 800 of the partition plate supplying mechansim 8. The bearing member 505 works to correctly control the position of the body proper 800 and also support an end portion of a connecting rod 690 rigidly connected to the body proper 600 of the feeder 6. As shown in FIG. 15B, a pair of grip members 850 and 851 are turnably mounted on the body proper 800 by means of respective pin shafts which pass through a middle portion of the corresponding member 850 or 851. A grip is formed at a free end portion of each member 851 and 850, while the other free end portions of the members 851 and 850 are pivoted to a pneumatic cylinder 852 and the piston rod 853 of the pneumatic cylinder 852. respectively.

In the above-mentioned arrangement of the stoppers, providing that the position of the body proper 800 which comes to a position between the position P2 and the position P3 is represented as a fourth position P4, and the position of the body proper 800 corresponding to the partition plate feed stand 15 is represented as a fifth position P5, a distance L1 between the position P1 and the position P4 is fixed so as to be equal to a distance between the position P2 and the position P5.

Next, the driving motion and positioning operation of the body propers 600 and 800 on the rail 5 is explained in detail.

Figure 15A:
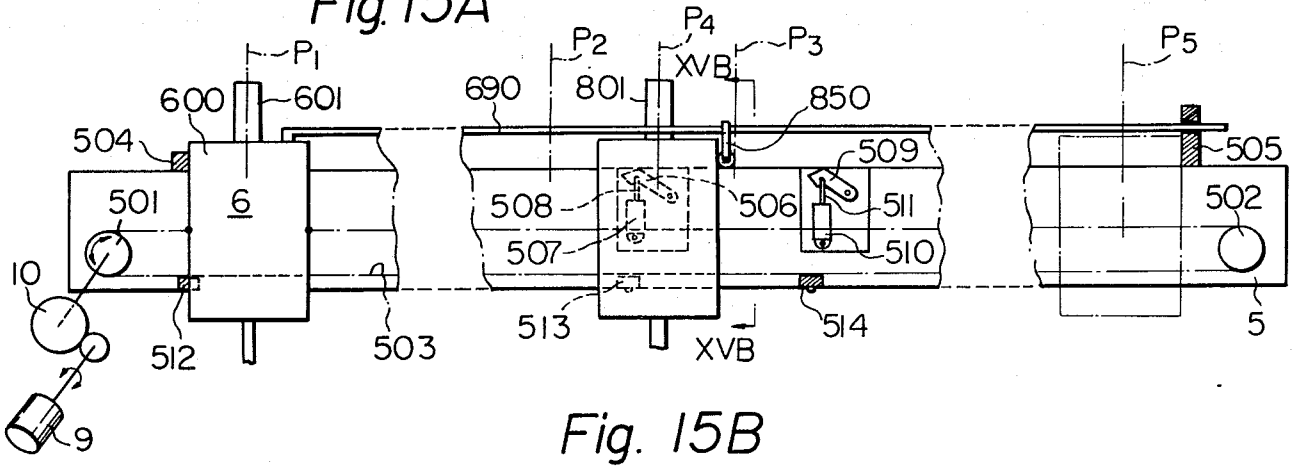
FIG. 15A is a schematic front view of the displacing mechanism shown in FIG. 14.
Figure 15B:
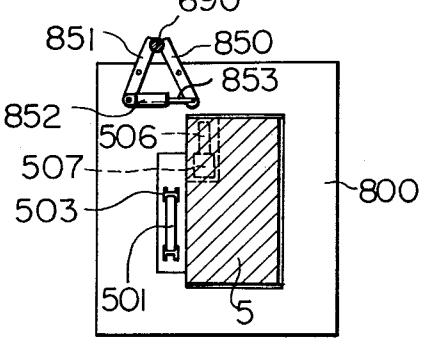
FIG. 15B is a cross-sectional view of the displacing mechanism, taken along a line XVB—XVB, in FIG. 15A.
Figure 16B:
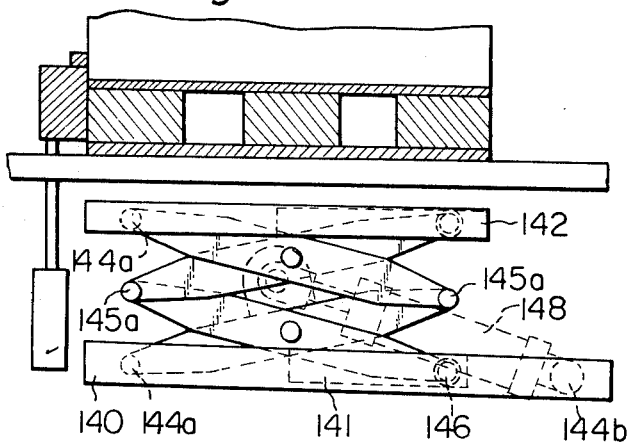
FIGS. 16A and 16B are schematic front views of the pallet lifting device shown in FIG. 1.
Figure 16A:
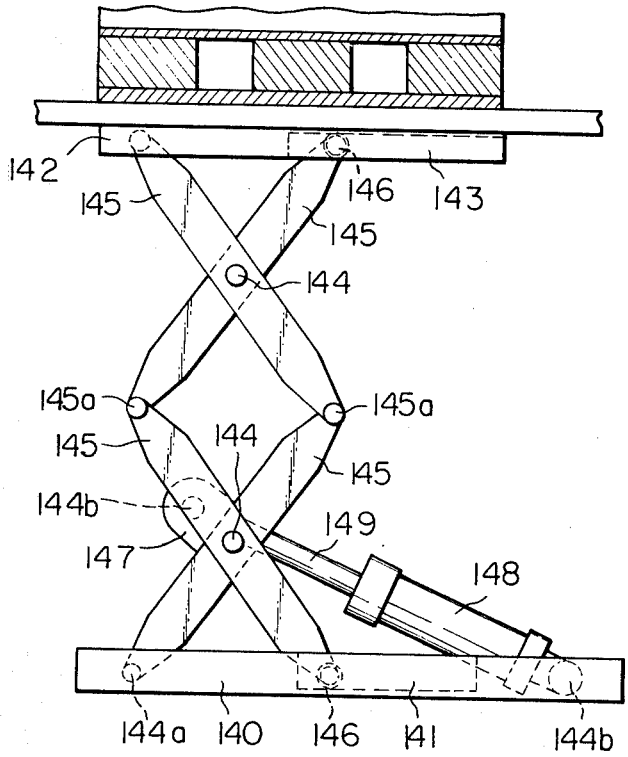
Figure 18:
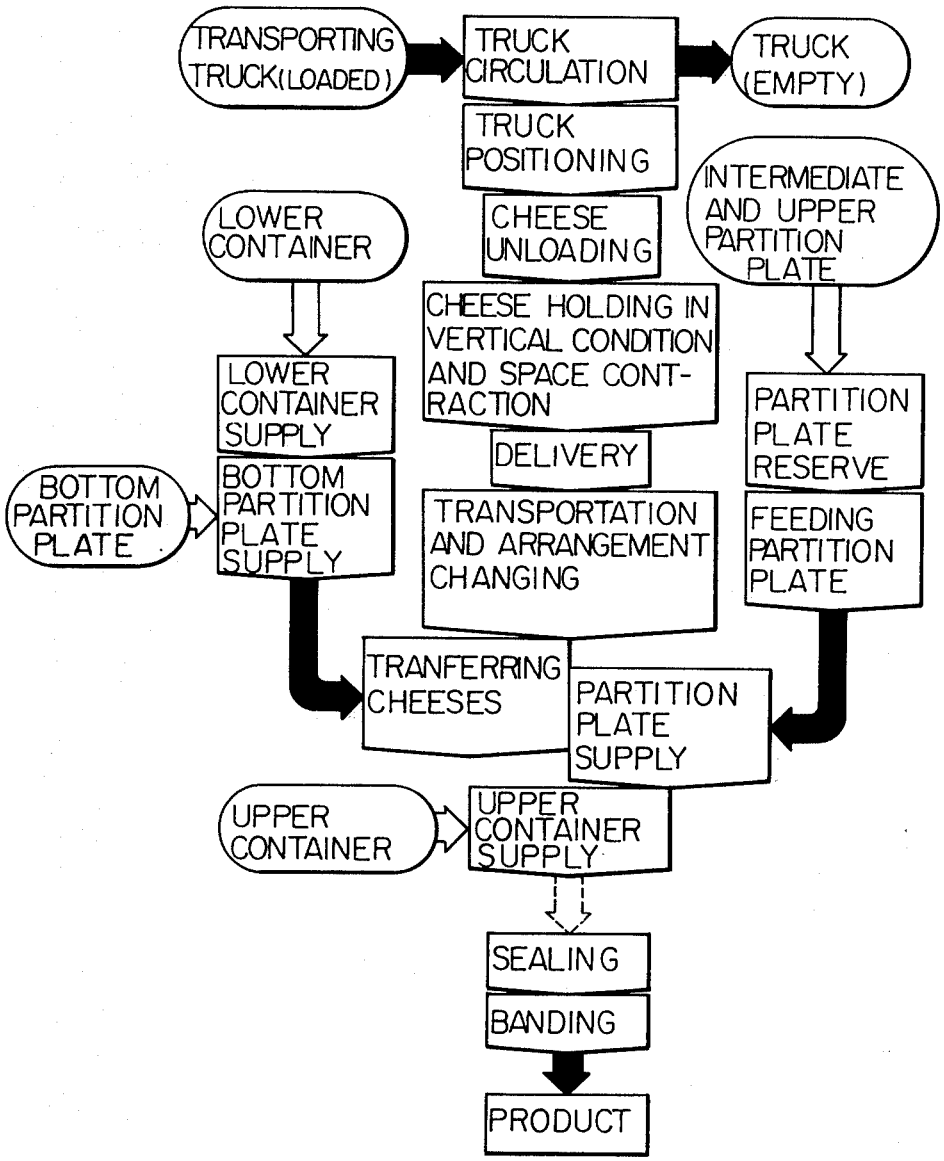
FIG. 18 is a flow chart for explaining the packaging operation by means of the apparatus according to the present invention.

When it is required to displace the body proper 600, which is positioned at P1, and the body proper 800, which is positioned at P4, to the positions P3 and P5 respectively: firstly, the pneumatic cylinder 507 is actuated to retract the piston rod 508 thereinto so as to retract the stopper 506 into the recess of the rail 5, while the pneumatic cylinder 852 is actuated to project the piston rod 853 so as to grip the connecting rod 690 by the grip members 850 and 851, and; secondly, the chain pulley 501 is driven clockwise (in FIG. 15A). Consequently the body proper 600 and the body proper 800 which is connected to the body proper 600 by means of the connecting rod 690 are displaced rightward (in FIG. 15A) by way of the driving of the chain 503. Right after the body proper 800 passes over the position where the stopper 509 is mounted in the recess of the rail 5, the pneumatic cylinder 510 is actuated so as to project the piston rod 511, in other words, so as to project the stopper 509 from the recess, by means of the limit switch 513 which is actuated by the proper 600. The pneumatic cylinder 853 is also actuated by the signal of the limit switch 513 so that the piston rod 853 is retracted thereinto, and consequently, the gripping of the connecting rod 690 by the grip members 850, 851 is released and the body proper 800 is stopped at the position P5. After the above-mentioned operation, the driving of the sprocket wheel 501 is stopped by the signal issued from the limit switch 514, and the body proper 600 is stopped at the position P3 by the action of the stopper 509.

When it is required to displace the body proper 600 positioned at the position P3 to the position P1, the pneumatic cylinder 507 is actuated so as to retract the rod 508 thereinto, thereby retracting the stopper 506 into the recess of the rail, and also the pneumatic cylinder 852 is actuated so as to retract the piston rod 853 thereinto, whereby the gripping of the connecting rod 690 by the grip members 850 and 851 is released. Thereafter the sprocket wheel 501 is driven in the counterclockwise direction (in FIG. 15A). Accordingly the body proper 600 is displaced toward the first position P1 without displacing the body proper 800.

When it is required to displace the body proper 600 from the first position P1 to the second position P2, the pneumatic cylinder 507 is actuated so as to project the piston rod 508, whereby ther stopper 506 is projected from the recess of the rail 5, and also the pneumatic cylinder 852 is actuated so as to retract the piston rod 853 thereinto, whereby the gripping of the connecting rod 690 by the grip members 850 and 851 is released. In this condition, the sprocket wheel 501 is rotated in the clockwise direction (in FIG. 15A) until the limit switch 513 is actuated by the body proper 600, so that the body proper 600 is stopped at the second position P2.

When it is required to displace the body proper from the second position to the first position, and to displace simultaneously the body proper 800 from the fifth position P5 to the fourth position P4, the pneumatic cylinders 507 and 510 are actuated so as to retract the piston rods 508 and 511 thereinto, respectively, so that the stoppers 506 and 509 are retracted into the rail 5; the pneumatic cylinder 852 is simultaneously actuated so as to project the piston rod 853, whereby the connecting rod 690 is gripped by the grip members 850 and 851. In this condition, the sprocket wheel 501 is rotated in the counterclockwise direction (in FIG. 15A) and, consequently, the body proper 600 connected to the chain 503 and the body proper 800 connected to the body proper 600 by way of the connecting rod 690 can be simultaneously displaced to the above-mentioned desired positions respectively. Since the relative motions of the pneumatic cylinders 507, 510 610, 801, 852 etc., the limit switches 501, 513, 514 etc. are carried out by control pneumatic and electric circuits provided with relays, magnetic valves like the control pneumatic and electic circuits shown in FIGS. 7 and 8, the detailed explanation thereof is omitted.

The lifting mechanism and lifting control method in the pallet lifting device 14 will now be described by reference to FIGS. 16A, 16B, 17A and 17B.

The lifting mechanism comprises a pair of pantograph systems, each including a lower base seat 140 having a groove 141, an upper base seat 142 having a groove 143 a pair of rising arms 145, each rising arm 145 having two parts turnably linked with each other at the center thereof by a pin 144 and both the arms 145 being turnably linked with each other through pins **145*a* and being turnably connected to the lower base seat 140 and upper base seat 142, respectively, two rotation rollers 146 are slidably inserted into the interiors of the grooves 141 and 143, in such a way that a shaft of these rollers 146 connects the corresponding two ends of the rising arms 145, a guide 147 formed on one of the rising arms 145, a pneumatic cylinder 148 and rod 149 thereof, the free ends of the cylinder 148 and rod 149 being turnably linked with the guide 147 and the lower base seat 140, respectively, through pins 144*b*. In the lifting mechanism having the above structure, when the pneumatic cylinder 148 is actuated to slide the rotation rollers 146 in the grooves 141 and 143, respectively, the upper base 142 is moved in the vertical direction. Since the operation for the vertical movement of the upper base seat 142 by the above lifting mechanism is apparent to those skilled in the art, a detailed explanation of this vertical movement of the upper base seat 142** is omitted.

The method for controlling the operation of the lifting mechanism when cheeses 1 are arranged in multiple columns in the cardbarod box 11 by means of this lifting mechanism will now be described with reference to FIGS. 16A, 16B, 17A, 17B, 18A and 18B.

A detecting rod 650 is slidably mounted on a part of the lift plate 602 in the feeder 6, that is, the rod 650 slidably passes through apertures formed in a pair of projections **602*a*, 602*b* of the lift plates 602. The rod 650 is provided with a laterally expanded flange 650*a* formed at a position between the projections 602*a* and 602*b* and a herical spring 651 is mounted on the rod 650 at a position between the flange 650*a* and the projection 602*b*. A limit switch 653 is disposed on the lift plate 602 to detect the movement of the detecting rod 650 through an upper projecting guide 652 of the detecting rod 650. A phototube 170 and a light receiving tube 171 are disposed at a predetermined position of a pillar (not shown) in the upper portion of the pallet lifting device 14**.

When cheeses 1 for the first column are to be loaded in the cardboard box 11, the partition plate feed device 8 carrying thereon the lowermost partition plate 17 is moved to a predetermined position over the pallet lifting device 14 and stopped at this position. Then, the lifting pneumatic cylinder 801 (FIG. 1) of the partition plate feed device 8 is actuated to displace the supporting mechansim for the partition plate 17 downwards, and simultaneously, the lifting pneumatic cylinder 148 (FIGS. 16A, 16B) in the pallet lifting device 14 is actuated to raise the cardboard box 11 to the uppermost position. In the above-mentioned operation, the supporting mechanism for the partition plate 17 and the cardboard box 11 are stopped prior to coming into contact with each other. Then, the supporting pneumatic cylinder 804 of the partition plate 17 feed device 8 is reversely operated to release holding of the partition plate 7 and the bottom partition plate 17 is placed in the cardboard box 11. Then, the lifting pneumatic cylinder 149 of the pallet lifting device 14 is reversely operated to bring down the cardboard box 11 to the herinbefore explained initial position. By means of the driving motor 9 and driving control device 10, the partition plate feed device 8 is moved to right above the partition feed device 15 (FIG. 1) and the feeder 6 which supports the cheeses 1, is moved to a position right above the pallet lifting device 14 and stopped in a condition as shown in FIG. 17A. Then, the lifting pneumatic cylinder 148 of the pallet lifting device 14 is actuated again to lift up the carton box 11, and the partition plate 17 in the cardboard box 11 comes into contact with the detecting rod 650 and pushes it upwardly. When the upper projecting guide 652 urges a feeder of the limit switch 653, the limit switch 653 is actuated to emit a detection signal. By this detection signal, the rising movement of the pallet lifting device 14 carrying, the cardboard box 11 is stopped, and the lift plate 602 of the feeder 6 is brought down by a predetermined distance by the operation of the lifting pneumatic cylinder 601 (FIG. 1) and the holding of the cheese 1 by the bobbin supporting member 619 (FIGS. 10A, 10B) attached to the lift plate 602 is released to set the cheeses 1 free. The position of the limit switch 653 and the length of the detecting rod 650 are adjusted to satisfy the following condition than when the lift plate 602 is brought down by a predetermined distance by the signal of the limit switch 653 from the position, where the plate 602 is originally held, the lower part of each of the bores of the cheese 1 supported by the bobbin supporting member 619 is inserted in the corresponding supporting cap 71*a* formed on the partition plate 17. Then, the cardboard box 11 is brought down to the initial position by the same procedures as described above, and the feeder 6 is caused to start a return motion to the standby position right above the lift 3 by the action of the driving motor 9 and the driving control device 10. After the above-mentioned operation, the lift 3 takes the cheeses 1 from the transporting truck 2 and rotate them to the vertical condition. The truck 2 from which all the cheeses 1 are taken off by the lift 3 is withdrawn by the transporting truck delivery mechanism (not shown), and another transporting truck 2 holding cheeses 1 is carried to the position where the lift 3 can be operated. The above-mentioned operation of placing eight cheeses 1 in the cardboard box 11 is performed two times, (that is, sixteen cheeses 1 are placed in the first layer in the cardboard box 11), and then, the partition plate feed device 8 which carries an intermediate partition plate 17 thereon, is displaced to right above the pallet lifting device 14. When the partition plate supporting mechanism of the partition plate feed device 8 is brought down by a predetermined distance, the pallet lifting device 14 carrying the cardboard box 11 is lifted up to a predetermined position. Then, by releasing the holding of the intermediate partition plate 17, the intermediate partition plate 17 is placed on the cheeses 1 of the first layer. When the same procedures as described above are repeated on the cheeses 1 for the second layer, the upper part of bore of the bobbin 1*a* (FIGS. 17A, 17B) of each cheese 1 is inserted into the lower supporting cap 71*b* of an intermediate partition plate 17, whereby the disposition of each cheese 1 is fixed.

After the above mentioned procedures have been repeated and cheeses 1 of two intermediate layers (32 cheeses as a whole) have been placed in the cardboard box 11, the movement of the pallet lifting device 14 is controlled by the phototube 170 and light receiving tube 171. More specifically, on completion of placing of cheeses 1 of the second column, the pallet lifting device 14 carrying the cardboard box 11 is not brought down to the prescribed initial position but the lowering movement is stopped when the position of the partition plate 17 located at the uppermost position at this time is detected by the phototube 170 and light receiving tube 171. In other words, the position of the partition plate 17 on which cheeses 1 are to be placed by the next operation is always at the same level as the position of the phototube 170 and light receiving tube 171 after the second layer of cheeses is placed in the cardboard box 11. Then, the feeder 6 is again moved to above the pallet lifting device 14 carrying the cardboard box 11 again and when the lift plate 602 is brought down by a predetermined distance, the lower end of each of the bobbin 1*a* of the cheeses 1 supported by the feeder 6 is inserted into the supporting cap of the partition plate 17 (in other words, when the cheeses 1 of the third and subsequent layers are placed, the box need not be moved upwardly).

By repeating the above-mentioned operation, four layers of cheeses 1 (64 cheeses total) are placed in the cardboard box 11, and the uppermost partition plate 17 is placed on the cheeses 1 of the uppermost layer (in this condition, the cheeses 1 of the lower two layers are contained in the interior of the cardboard box 11 but the cheeses 1 of the upper two layers are exposed to the outside). In this condition, the pallet lifting device 14 is brought down to the lowermost position, and the cardboard box 11 is placed on the belt 12 again, withdrawn from the pallet lifting device 14 and transferred onto a free roller belt 19.

The uppermost partition plate 17 is manually compressed to insert the lower supporting cap 71*b* of this plate 17 into the bobbin 1*a* of the cheese 1 so that the disposition of the cheeses 1 is fixed by this plate 17. Then, an upper cardboard box 20 (FIG. 1) of corrugated cardboard or the like having an inner diameter equal to the outer diameter of the box proper 111 of the cardboard box 11 is placed on the uppermost partition plate 17 to cover the cheeses 1 of the upper two layers. Then, a seal tape 21 is applied to make a seal between the box 20 and the box proper 111 and the assembly is packaged by passing bands through between every two adjacent spacers 113 as shown in FIG. 1. In the resulting package 23 (FIG. 1), many cheeses 1 (64 cheeses as a whole) are packed in superposed condition and the spacers 113 are disposed in the lower portion of the package 23 to provide a sufficient space for carrying out the loading operation by a conventional loading machine. Accordingly, this package 23 can be directly loaded on a transporting vehicle such as a freight car or a motor truck by a fork lift or the like.

In the foregoing embodiment, the cheeses are placed in four layers, each including 16 cheeses, but this mode of placing the cheeses may optionally be changed according to need.

The packaging operation of the cheeses by utilizing the apparatus according to the present invention is carried out very effectively. One of the preferable operations, for packaging a plurality of cheeses into a cardboard box or similar container in a two layer arrangement, is hereinafter explained with reference to the flow chart shown in FIG. 18. In this example, transportation trucks are circulated along a circulation passage of the truck for transporting a group of cheeses from a process for producing the cheeses to an unloading station for the making of the packaged product containing a plurality of cheeses and for returning the empty truck for the unloading station to the process for producing the cheeses. In the process of packaging a plurality of cheeses by utilizing a cardboard box or a like container, when the transporting truck loaded with cheese is carried to the unloading station, a group of cheeses are transferred to a receiving means of a lift automatically or manually. One of the preferable receiving means is a bobbin supporting member as shown in FIG. 4. Since each of the bobbin supporting members supports a cheese in a substantially horizontal condition, it is required to change the horizontal supporting condition to a vertical supporting condition. This operation is carried out by the mechanism for turning the supporting member holding plate shown in FIG. 3A and 3B. In this example, since the transporting truck is provided with a plurality of pegs arranged four to a row and the distances between two adjacent rows and two adjacent pegs on the same row are sufficiently large to prevent any possible contact of two adjacent cheeses, the distance between two adjacent bobbin supporting members shown in FIG. 4 is designed to equal that between the pegs of the transporting truck. However, it is essential to contract the space between cheeses supported by the respective supporting members before carrying the cheeses to the station for loading them into the cardboard box. It is a characteristic feature of the present invention that the intervening spaces between two alignment of cheeses supported by the respective bobbin supporting members is contracted automatically. This operation is carried out by the first space contracting mechanism shown in FIGS. 6A and 6B. Naturally, however, in a case where the transferring of the cheeses from the transporting truck to the respective bobbin supporting members is carried out manually, if the arrangement of these bobbin supporting members is originally compact, such space contracting operation is not necessary.

In the conventional transporting truck, it is usual to arrange a plurality of pegs for supporting cheeses in a zig-zag relationship. Therefore, if the transferring of the cheeses from these pegs of the transporting truck to the bobbin supporting members of the lift is carried out automatically, even if the distance between two adjacent alignments of cheeses is contracted by the first space contracting mechanism shown in FIGS. 6A and 6B, it is required to change the zig-zag arrangement of cheeses to a correct lattice arrangement before transferring these cheeses into a cardboard box. This operation is carried out by means of the mechanism for changing the arrangement of the bobbin supporting members shown in FIGS. 9A and 9B. The above-mentioned correction of the arrangement of cheeses is carried out during the transporting while these cheeses are being carried to a station for loading then into the cardboard box. In this example, the cheeses received by the supporting members of the lift are received by the corresponding bobbin supporting members mounted on a feeder which is capable of displacing along a horizontal rail disposed above the lift and the packaging station. The above-mentioned receiving and displacing operation is carried out by the feeder and the driving mechanism thereof shown in FIGS. 1, 10A, 10B, 14 15A and 15B. These mechanisms are also one of the important features of the apparatus according to the present invention.

During the above-mentioned operations, it is required to prepare a cardboard box or similar container for receiving the rearranged cheeses. In this example, an open top cardboard box is supplied to a loading station standby position before the feeder is displaced to a position right above the loading station. To protect, and also to fix the disposition of the cheeses in the cardboard box, a bottom partition plate is disposed at the bottom of the box. This partition plate is provided with a plurality of holding caps, each of which is capable of being inserted into the bottom of the bore of every cheese. Therefore, these caps are arranged in a desired compacted condition for packaging. When the feeder has carried the cheeses to the position right above the cardboard box positioned at the above-mentioned standby position, the cardboard box is lifted upward to a predetermined position while a member holding the bobbin supporting members is displaced downward so as to transfer the cheeses onto respective caps arranged in two adjacent rows on the lower partition plate in the cardboard box. The above-mentioned operation is carried out by the pallet lifting device shown in FIGS. 16A and 16B.

Next the pallet lifting device is actuated to displace the above-mentioned cardboard box to its standby position and the holding member is returned to its uppermost position. Thereafter, the feeder is displaced to the position right above the lift. During the above-mentioned returned motion of the feeder, the second group of cheeses of the above-mentioned transportation truck are transferred to the lift and, then, the feeder receives these cheeses from the lift and carried them to a second position right above the packaging station. During the above-mentioned operation, the spaces between two adjacent rows of cheeses and between two adjacent cheeses of the same row are contracted as in the above-mentioned first operation for loading the cheeses into the cardboard box. When the feeder is displaced to the position right above the second packaging station, the pallet lifting device is actuated so as to lift the cardboard box to a predetermined position while the holding member is displaced downward so as to place the cheeses on the caps in two adjacent rows different from the other two adjacent rows. Consequently, the above-mentioned group of cheeses are stably disposed on the above-mentioned caps.

The partition plates are supplied from a partition plate feed stand disposed at a position right below a terminal of the horizontal rail as shown in FIG. 1. A partition plate feeding device provided with a mechanism for reserving a partition plate feeds a desired partition plate from the partition plate feed stand into the cardboard box disposed on the pallet lifting device. This feeding device and reserve mechanism are shown in FIGS. 1, 13A, 13B, 14 and 15A.

When predetermined number of cheeses are stably disposed on the bottom partition plate, an intermediate partition plate is mounted on the bobbins of these cheeses by means of the partition plate feeding device so that the lower caps of the intermediate partition plate hold these bobbins in a stable condition. Thereafter, the loading operation of the cheeses onto the intermediate partition plate is carried out in the same manner as the above-mentioned operation. Finally, the uppermost partition plate is mounted on the cheeses disposed on the intermediate partition plate in the same manner as the supplying operation of the intermediate partition plate. Thereafter, the top aperture of the cardboard box is closed and sealed and the box is bound with bands so that a complete package of a cardboard box containing 32 cheeses is produced.

If an additional 32 cheeses are to be packaged with the above-mentioned 32 cheeses, a further two layers of cheeses are mounted on the above-mentioned second layer of cheeses by way of intermediate partition plates. The cheese supplying motion onto the above-mentioned package before sealing is repeated twice for forming each additional layer of cheeses. Upon completion of the operation for mounting the cheeses in the uppermost layer, a fresh cardboard box without a bottom is mounted on the package so as to surround the uppermost two layers of cheeses. Thereafter, the above-mentioned sealing and banding operations are carried out so that a fresh package containing 64 fresh cheeses is produced.

In the foregoing embodiment, feeding of the partition plates is performed automatically, but this feeding operation may be accomplished manually. Further, although packaging operations such as sealing with a sealing tape and banding with bands are performed manually in the foregoing embodiment, these operations may be performed automatically.

As will be apparent from the explanation hereinbefore presented, according to the packaging apparatus of this invention, the packaging cost per cheese can be remarkably reduced and the possible damage of the cheeses during transportation can also be remarkably reduced. Further, a package of cheeses formed according to the apparatus of this invention need not be subjected to the palletizing step, and the operation of loading such packages on a freight car or truck can be remarkably facilitated and rationalized.

In the above-mentioned packaging operation by utilizing the apparatus according to the present invention, when the cheese 1 are transferred from the transporting truck 2 to the lift 3 and from the lift 3 to the feeder 6, the transfer operation is carried out by inserting a bobbin supporting member into the bore of a bobbin of the cheese 1. When the cheeses 1 are transferred from the feeder 6 to the cardboard box 11, the transfer operation is carried out by releasing the bobbin supporting member from the bore of the bobbin of each cheese 1 and the corresponding cap is inserted into the other end of the bore of the bobbin. Consequently, the top end of each cheese 1 mounted on the corresponding peg of the transporting truck 2 is changed to the bottom end of the cheese 1 when the cheese 1 is transferred into the cardboard box 11. Such changing of the position of the ends of the bobbin creates a very easy operational condition for handling the pig tail of the cheese 1.

What is claimed is:

1. An apparatus for packaging a plurality of yarn packages in a cardboard box or a like container, comprising:

an over head guide rail disposed at a position above stations for carrying out the packaging operation;

a lift provided with means for supporting a plurality of yarn packages in upright condition and transporting said supported yarn packages to an uppermost predetermined position adjacently below said guide rail;

a pallet lifting device for displacing said cardboard box to a predetermined position for receiving said packages into said cardboard box;

a feeder capable of moving along said guide rail between a position right above said uppermost predetermined position of said lift and one of a plurality of predetermined position substantially above said pallet lifting device;

means for displacing said feeder along said guide rail;

means for displacing said cardboard box from said pallet lifting device;

means for sealing said cardboard box after completion of the transfer motion of cheeses from said feeder into said cardboard box and displacing said cardboard box from said pallet lifting device;

means for binding said sealed cardboard box;

said feeder being provided with members supporting said yarn packages in vertical condition, means for changing the arrangement of the supported yarn packages into a square lattice arrangement and means for displacing said supporting members to vertical direction;

whereby, yarn packages received by said lift are firstly displaced to said uppermost position of said lift and, then, said supporting members of said feeder are displaced downward to receive said yarn packages by means of said displacing means of said feeder, and after said supporting members completely receive said yarn packages from said lift, said feeder is displaced to one of said predetermined position right above a position of said cardboard box where said yarn packages are desired to be positioned, said means for changing the arrangement of the supported yarn packages is actuated so as to correctly arrange said supported yarn packages in a square lattice arrangement before releasing said supporting members from the respective yarn packages and said pallet lifting device displaces said cardboard box upward to a predetermined uppermost position thereof, then, said displacing means of said feeder is actuated to displace siad supporting members toward said cardboard box, and thereafter, said supporting members are actuated to release these yarn packages, and after repeating the above-mentioned operations, if necessary, and when the space in said cardboard box is occupied by a predetermined number of yarn packages, said pallet lifting device is actuated to displace said cardboard box downward and, thereafter, the operations of said sealing means and binding means are carried out.

2. An apparatus for packaging a plurality of yarn packages in a cardboard box or a like container according to claim 1, further comprising means for supplying a partition plate into said cardboard box, which means is positioned at any one of said predetermined positions above said pallet lifting device, said supplying means comprising a body proper which is capable of moving along said guide rail between a supply position of said partition plate and a position right above said cardboard box positioned on said pallet lifting device, means for temporarily holding said partition plate, means for displacing said holding means in vertical direction and means for actuating said holding means for holding said partition plate or releasing said partition plate.

3. An apparatus for packaging a plurality of yarn packages in a cardboard box or a like container according to claim 2, wherein said partition plate supply means is selectively connected to said feeder.

4. An apparatus for packaging a plurality of yarn packages in a cardboard box or a like container according to claim 2, further comprising an electrical and pneumatic control means for controlling the relative displacing motions of said feeder and said partition plate feed device on said guide rail.

5. An apparatus for packaging a plurality of yarn packages in a cardboard box or a like container according to claim 1, further comprising an auxiliary transportation rail for supplying a cardboard box onto said pallet lifting device.

6. An apparatus for packaging a plurality of yarn packages in a cardboard box or a like container according to claim 1, wherein said lift is provided with a vertical guide shaft, a slide block which is capable of displacing along said guide shaft, driving means for displacing said slide block along said guide shaft, a plurality of supporting members for temporarily holding said yarn packages, means for displacing said supporting members in a forward or rearward direction, a supporting plate which supports said supporting members, means for turnably mounting said supporting plate on said displacing means, pneumatic means for actuating said displacing means in connection with said mounting means and control means for selectively positioning said slide block at one of a plurality of predetermined positions on said guide shaft.

7. An apparatus for packaging a plurality of yarn packages in a cardboard box or a like container according to claim 4, wherein said supporting members are mounted on said supporting plate in a condition of two alignments by way of means for changing an intervened distance between said two alignments of said supporting members.

8. An arrangement for packaging a plurality of yarn packages in a cardboard box or a like container according to claim 4, further comprising an electrical and pneumatic control means for controlling the relative motions of the members constituting said lift.

9. An apparatus for packaging a plurality of yarn packages in a cardboard box or a like container according to claim 1, wherein said feeder is provided with a body proper and a lifting plate which is mounted on said body proper in displaceable condition toward the vertical direction, said displacing means is a pneumatic means for displacing said lifting plate, said means for changing the arrangement of the supported yarn packages is mounted on said lifting plate, said means for changing the arrangement of the supported yarn packages is provided with a plurality of holding plates which are relatively displaceably mounted thereon and pneumatic means for relatively displacing said holding plates, said supporting members being mounted on corresponding holding plates.

10. An apparatus for packaging a plurality of yarn packages in a cardboard box or a like container according to claim 9, wherein said pneumatic means is actuated during the movement of said body proper of said feeder from said position right above said lift to one of said predetermined positions substantially above said pallet lifting device.

11. An apparatus for packaging a plurality of yarn packages in a cardboard box or a like container according to claim 9, further comprising an electrical and pneumatic control means for controlling the relative motions of the members constituting said feeder.

12. An apparatus for packaging a plurality of yarn packages in a cardboard box or a like container according to claim 1, wherein said pallet lifting device is provided with means for detecting the position of said cardboard box when said box is lifted upward to a predetermined position, and means for stopping the lifting motion of said pallet lifting device due to a signal issued from said detecting means.

13. An apparatus for packaging a plurality of yarn packages in a cardboard or a like container according to claim 12, wherein said detecting means is a projector and a photoelectric tube disposed at an identical level in such a condition that a light beam projected from said light projector can be received by said photoelectric tube and when an upper edge of said cardboard box crosses said light beam, said photoelectric tube issues a signal.

* * * * *

UNITED STATES PATENT OFFICE
CERTIFICATE OF CORRECTION

Patent No. 4,043,097 Dated August 23, 1977

Inventor(s) Kinyu Ishida, et al

It is certified that error appears in the above-identified patent and that said Letters Patent are hereby corrected as shown below:

Column 2, line 1: "transporation" should be --transportation--.

Column 4, line 56: "308k" should be --308--.

Column 7, line 8: "denergized" should be --deenergized--.

line 21: "upwrdly" should be --upwardly--.

line 38: "chesses" should be --cheeses--.

line 40: "vlave" should be --valve--.

Column 8, line 8: "cylinder 349" should be --cylinder 348--.

Column 10, lin 29: "262" should be --626--.

Column 12, line 6: "bobbing" should be --bobbin--.

UNITED STATES PATENT OFFICE

CERTIFICATE OF CORRECTION

Patent No. 4,043,097 Dated August 23, 1977

Inventor(s) Kinyu Ishida, et al.

It is certified that error appears in the above-identified patent and that said Letters Patent are hereby corrected as shown below:

Column 13, line 18: "succh" should be --such--.

Column 16, line 37: "sider" should be --slider--.

line 66: "sidably" should be --slidably--.

Column 17, line 4: "not" should be --now--; "chansim" should be --chanism--.

Column 18, line 6: "mechansim" should be --mechanism--.

line 50: Before "proper" insert --body--.

line 51: "cylinder 853" should be --cylinder 852--.

Column 19, line 8: "ther" should be --the--.

Column 20, line 1: "lifit" should be --lift--.

line 3: "cardbarod" should be --cardboard--.

line 41: "herin-" should be --herein- --.

line 64: "than" should be --that--.

UNITED STATES PATENT OFFICE

CERTIFICATE OF CORRECTION

Patent No. 4,043,097 Dated August 23, 1977

Inventor(s) Kinyu Ishida, et al.

It is certified that error appears in the above-identified patent and that said Letters Patent are hereby corrected as shown below:

Column 25, line 40: "position" should be --positions--.

Column 26, line 6: "siad" should be --said--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*